US010176791B2

(12) United States Patent
Jeon et al.

(10) Patent No.: US 10,176,791 B2
(45) Date of Patent: Jan. 8, 2019

(54) ELECTRONIC DEVICE, METHOD FOR RECOGNIZING PLAYING OF STRING INSTRUMENT IN ELECTRONIC DEVICE, AND METHOD FOR PROVIDNG FEEDBACK ON PLAYING OF STRING INSTRUMENT IN ELECTRONIC DEVICE

(71) Applicant: Samsung Electronics Co., Ltd., Suwon-si, Gyeonggi-do (KR)

(72) Inventors: Dae Young Jeon, Seoul (KR); Yeon Su Kim, Seongnam-si (KR); Yeong Min Kim, Suwon-si (KR); Jung Min Park, Seoul (KR); Kyung Seok Oh, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/066,655

(22) Filed: Mar. 10, 2016

(65) Prior Publication Data

US 2016/0267895 A1 Sep. 15, 2016

(30) Foreign Application Priority Data

Mar. 13, 2015 (KR) ..... 10-2015-0034929

(51) Int. Cl.

| | |
|---|---|
| ***G10H 7/12*** | (2006.01) |
| ***G10H 3/18*** | (2006.01) |
| ***G10H 1/00*** | (2006.01) |
| ***G10H 3/14*** | (2006.01) |
| ***G10H 1/32*** | (2006.01) |
| ***G10H 3/12*** | (2006.01) |

(52) U.S. Cl.

CPC ..... *G10H 3/181* (2013.01); *G10H 1/0016* (2013.01); *G10H 1/32* (2013.01); *G10H 3/125* (2013.01); *G10H 3/146* (2013.01); *G10H 2210/091* (2013.01); *G10H 2220/121* (2013.01); *G10H 2220/165* (2013.01); *G10H 2220/365* (2013.01); *G10H 2220/395* (2013.01); *G10H 2220/401* (2013.01); *G10H 2220/415* (2013.01); *G10H 2220/441* (2013.01); *G10H 2220/455* (2013.01); *G10H 2220/525* (2013.01); *G10H 2230/015* (2013.01)

(58) Field of Classification Search

USPC ..... 84/609

See application file for complete search history.

(56) References Cited

U.S. PATENT DOCUMENTS 2,229,189 A * 1/1941 Rice ..... G10D 3/02 84/310

6,162,981 A * 12/2000 Newcomer ..... G09B 15/04 84/470 R (Continued)

FOREIGN PATENT DOCUMENTS

JP 2011-221472 A 11/2011

OTHER PUBLICATIONS

Zhang et al. Visual Analysis of Fingering for Pedagogical Violin Transcription; Proceedings of the 15th International Conference on Multimedia 2007; Sep. 23-28, 2007; Augsburg, Germany.

(Continued)

*Primary Examiner* — Christopher Uhlir

(74) *Attorney, Agent, or Firm* — Jefferson IP Law, LLP

(57) ABSTRACT

An electronic device is provided. The electronic device includes an image sensor configured to sense a motion of a bow to the string instrument, a vibration sensor configured to sense a vibration generated by the string instrument, and a control module configured to determine a fingering position of a user with respect to the string instrument using the motion of the bow and the vibration.

10 Claims, 25 Drawing Sheets

(56) References Cited

U.S. PATENT DOCUMENTS

| | | | | |
|---|---|---|---|---|
| 8,084,678 | B2 * | 12/2011 | McMillen | G10D 3/16 84/282 |
| 8,109,146 | B2 * | 2/2012 | Young | G10H 1/46 73/510 |
| 8,338,684 | B2 | 12/2012 | Pillhofer et al. | |
| 8,492,641 | B2 * | 7/2013 | Menzies-Gow | G10H 1/0553 84/724 |
| 8,785,757 | B2 | 7/2014 | Pillhofer et al. | |
| 8,907,193 | B2 | 12/2014 | Cross et al. | |
| 2006/0236850 | A1 * | 10/2006 | Shaffer | G10H 3/125 84/724 |
| 2009/0188369 | A1 | 7/2009 | Chen et al. | |
| 2009/0216483 | A1 | 8/2009 | Young | |
| 2009/0308232 | A1 | 12/2009 | McMillen et al. | |
| 2011/0207513 | A1 | 8/2011 | Cross et al. | |
| 2011/0259176 | A1 | 10/2011 | Pillhofer et al. | |
| 2012/0240751 | A1 * | 9/2012 | Yonetani | G10H 3/18 84/726 |
| 2012/0272814 | A1 | 11/2012 | Menzies-Gow | |
| 2013/0233152 | A1 | 9/2013 | Pillhofer et al. | |
| 2015/0157945 | A1 | 6/2015 | Cross et al. | |

OTHER PUBLICATIONS

Wang et al.; Educational Violin Transcription by Fusing Multimedia Streams; Proceedings of the International Workshop on Educational Multimedia and Multimedia Education, EMME '07; Sep. 28, 2007; Augsburg, Germany.

Schoonderwaldt et al.; Extraction of bowing parameters from violin performance combining motion capture and sensors; The Journal of the Acoustical Society of America; vol. 26, No. 5; Aug. 23, 2009.

Maezawa et al.; Violin Fingering Estimation Based on Violin Pedagogical Fingering Model Constrained by Bowed Sequence Estimation from Audio Input; Trends in Applied Intelligent Systems; Springer Berlin Heidelberg, Berlin, Heidelberg; Jun. 1, 2010.

De Sorbier et al.; Violin Pedagogy for Fingering and Bow Placement using Augmented Reality; Signal & Information Processing Association Annual Summit and Conference (APSIPA ASC); 2012 Asia-Pacific, IEEE, Dec. 3, 2012.

Paradiso et al; Musical Applications of Electric Field Sensing; Computer Music Journal, 21; 2; pp. 69-89; 1997; Cambridge, MA.

Yin et al.; Digital Violin Tutor: An Integrated System for Beginning Violin Learners; In Proc. ACM Multimedia; pp. 976-985; Nov. 6-11, 2005; Signapore.

Young et al.; A methodology for Investigation of Bowed String Performance Through Measurement of Violin Bowing Technique; Ph.D. thesis; M.I.T.; Feb. 2007.

Schoonderwaldt; Mechanics and Acoustics of Violin Bowing: Freedom, constraints and control in performance; Ph.D. thesis; KTH Computer Science and Communication; 2009; Stockholm, Sweden.

Pardue et al.; Low-Latency Audio Pitch Tracking: a Multi-Modal Sensor-Assisted Approach; Proceedings of the International Conference on New Interfaces for Musical Expression; p. 54-59; 2014; London, UK.

Young, Diana . "Playability Evaluation of a Virtual Bowed String Instrument." (2003); Montreal, Canada.

Wang, Jian-Heng et al. "Real-Time Pitch Training System for Violin Learners" (2012); Taiwan.

* cited by examiner

ELECTRONIC DEVICE, METHOD FOR RECOGNIZING PLAYING OF STRING INSTRUMENT IN ELECTRONIC DEVICE, AND METHOD FOR PROVIDNG FEEDBACK ON PLAYING OF STRING INSTRUMENT IN ELECTRONIC DEVICE

CROSS-REFERENCE TO RELATED APPLICATION(S)

This application claims the benefit under 35 U.S.C. § 119(a) of a Korean patent application filed on Mar. 13, 2015 in the Korean Intellectual Property Office and assigned Serial number 10-2015-0034929, the entire disclosure of which is hereby incorporated by reference.

TECHNICAL FIELD

The present disclosure relates to electronic devices for recognizing the playing of string instruments and providing feedback on the playing of the string instruments.

BACKGROUND

With the development of electronic technologies, various electronic devices have been developed. For example, devices for recognizing playing operations of an instrument using a bow have been developed. There have been attempts to accurately recognize playing operations of such an instrument using various types of sensors.

Part of a device which recognizes the playing of a string instrument is implemented in a form that is mounted on a bow. Therefore, since the entire weight of the bow is increased and since the center of gravity of the bow is changed, this interferes with the playing of the string instrument.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a method for recognizing the playing of a string instrument using an electronic device mounted on the string instrument and providing a variety of feedback to a user using obtained playing data.

In accordance with an aspect of the present disclosure, an electronic device is provided. The electronic device includes an image sensor configured to sense a motion of a bow to the string instrument, a vibration sensor configured to sense a vibration generated by the string instrument, and a control module configured to determine a fingering position of a user with respect to the string instrument using the motion of the bow and the vibration.

In accordance with another aspect of the present disclosure, an electronic device is provided. The electronic device includes a display, a communication module configured to receive string instrument playing data of a user from an external electronic device, and a control module configured to analyze an error pattern of the user using the playing data and to provide feedback on the error pattern on the display.

In accordance with another aspect of the present disclosure, a method for recognizing the playing of a string instrument in an electronic device is provided. The method includes sensing a motion of a bow to the string instrument, sensing a vibration generated by the string instrument, and determining a fingering position of a user with respect to the string instrument using the motion of the bow and the vibration.

In accordance with another aspect of the present disclosure, a method for providing feedback on the playing of a string instrument in an electronic device is provided. The method includes receiving string instrument playing data of a user from an external electronic device, analyzing an error pattern of the user using the playing data, and providing feedback on the error pattern.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
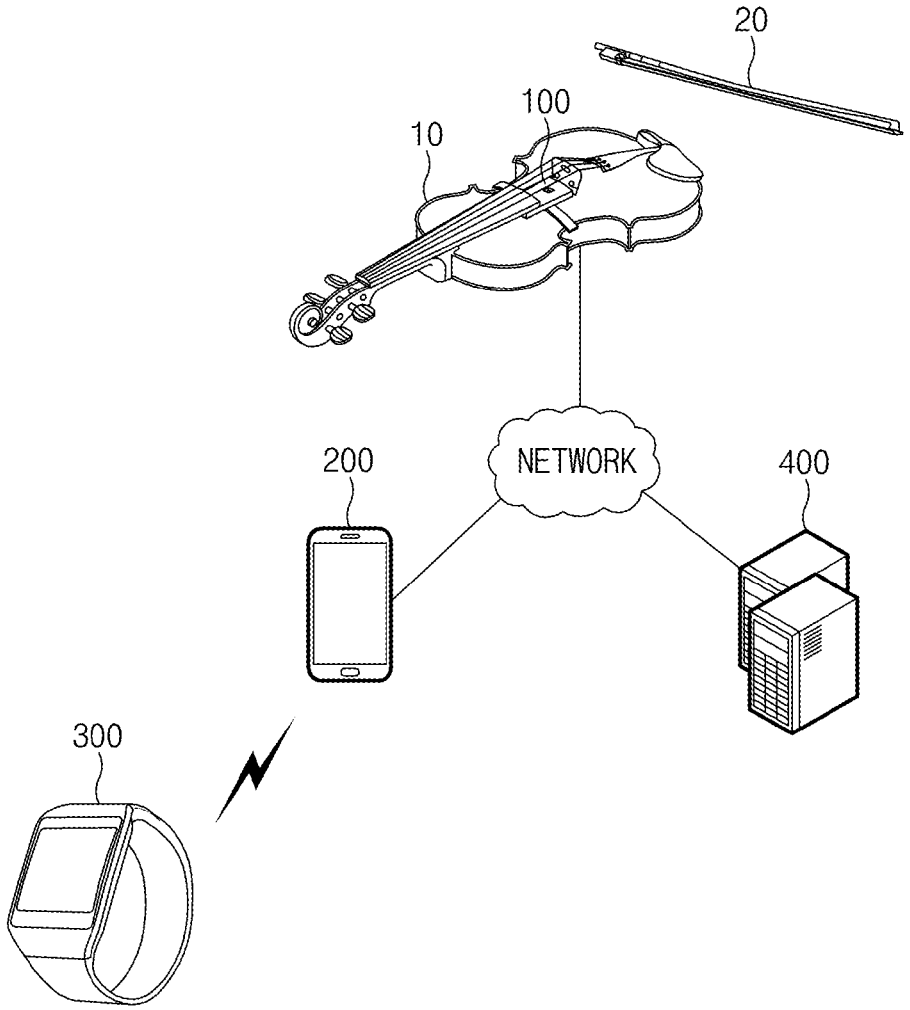
FIG. 1 is a drawing illustrating a configuration of a string instrument playing system according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the following disclosure, the expressions "have", "may have", "include" and "comprise", or "may include" and "may comprise" indicate the existence of corresponding features (e.g., elements such as numeric values, functions, operations, or components) but do not exclude the presence of additional features.

In the following disclosure, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The expressions such as "1st", "2nd", "first", or "second", and the like used in various embodiments of the present disclosure may refer to various elements irrespective of the order and/or priority of the corresponding elements, but do not limit the corresponding elements. The expressions may be used to distinguish one element from another element. For instance, both "a first user device" and "a second user device" indicate different user devices from each other irrespective of the order and/or priority of the corresponding elements. For example, a first component may be referred to as a second component and vice versa without departing from the scope of the present disclosure.

It will be understood that when an element (e.g., a first element) is referred to as being "(operatively or communicatively) coupled with/to" or "connected to" another element (e.g., a second element), it can be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

Depending on the situation, the expression "configured to" used herein may be used as, for example, the expression "suitable for", "having the capacity to", "designed to", "adapted to", "made to", or "capable of". The term "configured to" must not mean only "specifically designed to". Instead, the expression "a device configured to" may mean that the device is "capable of" operating together with another device or other components. For example, a "processor configured to perform A, B, and C" may mean a generic-purpose processor (e.g., a central processing unit (CPU) or an application processor (AP)) which may perform corresponding operations by executing one or more software programs which stores a dedicated processor (e.g., an embedded processor) for performing a corresponding operation.

Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal manner unless expressly so defined herein in various embodiments of the present disclosure. In some cases, even if terms are defined in the present disclosure, they may not be interpreted to exclude various embodiments of the present disclosure.

Electronic devices (e.g., a first electronic device 100 and a second electronic device 200) according to various embodiments of the present disclosure may include at least one of, for example, a smart phone, a tablet personal computer (PC), a mobile phone, a video telephone, an electronic book reader, a desktop PC, a laptop PCs, a netbook computer, a workstation, a server, a personal digital assistant (PDA), a portable multimedia player (PMP), a Motion Picture Experts Group (MPEG-1 or MPEG-2) audio layer 3 (MP3) player, a mobile medical device, a camera, or a wearable device. According to various embodiments of the present disclosure, the wearable device may include at least one of an accessory-type wearable device (e.g., a watch, a ring, a bracelet, an anklet, a necklace, glasses, contact lenses, or a head-mounted-device (HMD)), fabric or a clothing integral wearable device (e.g., electronic clothes), a body-mounted wearable device (e.g., a skin pad or a tattoo), or an implantable wearable device (e.g., an implantable circuit).

According to various embodiments of the present disclosure, the electronic devices may be a smart home appliance. The smart home appliance may include at least one of, for example, a television (TV), a digital versatile disc (DVD) player, an audio, a refrigerator, an air conditioner, a cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, or an electronic picture frame.

According to various embodiments of the present disclosure, the electronic devices may include at least one of various medical devices (e.g., various portable medical measurement devices (e.g., blood glucose meters, heart rate meters, blood pressure meters, or thermometers, and the like), a magnetic resonance angiography (MRA), a magnetic resonance imaging (MRI), a computed tomography (CT), scanners, or ultrasonic devices, and the like), a navigation device, a global navigation satellite system (GNSS), an event data recorder (EDR), a flight data recorder (FDR), a vehicle infotainment device, an electronic equipment for a vessel (e.g., a navigation system, a gyrocompass, and the like), avionics, a security device, a head unit for vehicles, an industrial or home robot, an automatic teller machine (ATMs), a point of sales (POS), or an internet of things (e.g., a light bulb, various sensors, an electric or gas meter, a sprinkler device, a fire alarm, a thermostat, a street lamp, a toaster, exercise equipment, a hot water tank, a heater, a boiler, and the like).

According to various embodiments of the present disclosure, the electronic devices may include at least one of parts of furniture or buildings/structures, electronic boards, electronic signature receiving devices, projectors, or various measuring instruments (e.g., water meters, electricity meters, gas meters, or wave meters, and the like). The electronic devices according to various embodiments of the present disclosure may be one or more combinations of the above-mentioned devices. The electronic devices according to various embodiments of the present disclosure may be flexible electronic devices. Also, electronic devices according to various embodiments of the present disclosure are not limited to the above-mentioned devices, and may include new electronic devices according to technology development Hereinafter, electronic devices according to various embodiments of the present disclosure will be described with reference to the accompanying drawings. The term "user" used herein may refer to a person who uses an electronic device or may refer to a device (e.g., an artificial electronic device) that uses an electronic device.

FIG. 1 is a drawing illustrating a configuration of a string instrument playing system according to an embodiment of the present disclosure.

Referring to FIG. 1, the string instrument playing system may include a first electronic device 100, a second electronic device 200, a third electronic device 300, and a server 400. The first electronic device 100, the second electronic device 200, the third electronic device 300 and the server 400 may connect with each other over a network to communicate with each other. For one example, the first electronic device 100, the second electronic device 200, and the third electronic device 300 may connect with each other using local-area wireless communication technologies such as Bluetooth, near field communication (NFC), and Zigbee. For another example, the server 400 may connect with the second electronic device 200 or the third electronic device 300 over an internet network or a mobile communication network.

According to various embodiments of the present disclosure, the electronic device 100 may detect playing data generated as a user plays the string instrument 10. The string instrument 10 may be, for example, a string instrument the user plays using a bow 20. According to various embodiments of the present disclosure, the string instrument 10 may include any string instrument that a user plays using a bow. However, for convenience of description, an embodiment of the present disclosure is exemplified wherein the string instrument 10 is a violin. The playing data may include, for example, at least one of a pitch, a sound intensity, a rhythm, a longitudinal position of the bow 20, a lateral position of the bow 20, a relative tilt between the bow 20 and a string, a skewness of the bow 20 in the direction of a fingerboard, an inclination of the bow 20 in the direction of a body of the string instrument 10, a type of a string with which the bow 20 makes contact, a fingering position of the user, or a velocity of the bow 20. According to an embodiment of the present disclosure, the first electronic device 100 may be implemented with a structure of being attached (or coupled) to the string instrument 10. According to an embodiment of the present disclosure, the first electronic device 100 may send the playing data to the second electronic device 200. For example, the first electronic device 100 may send the playing data in the form of a music instrument digital interface (MIDI) or a music extensible markup language (XML).

According to an embodiment of the present disclosure, the second electronic device 200 may be a portable electronic device, such as a smartphone or a tablet PC, or a wearable electronic device, such as a smart watch or smart glasses. According to an embodiment of the present disclosure, the second electronic device 200 may receive playing data of the user from the first electronic device 100. According to an embodiment of the present disclosure, the second electronic device 200 may compare the playing data with sheet music data and may determine a playing result of the user (e.g., whether playing of the user is normal playing or whether an error occurs in playing of the user). According to an embodiment of the present disclosure, the second electronic device 200 may determine the playing result of the user in real time and may provide feedback corresponding to the playing result. According to an embodiment of the present disclosure, the second electronic device 200 may determine a playing pattern (e.g., a normal playing pattern and an error pattern) of the user according to the playing result. For example, the second electronic device 200 may analyze a playing pattern of the user using a pattern analysis algorithm According to an embodiment of the present disclosure, the second electronic device 200 may determine the playing pattern of the user in real time and may provide real-time feedback associated with an error pattern.

According to an embodiment of the present disclosure, the second electronic device 200 may send the playing data, the playing result, and the playing pattern of the user to the server 400. According to an embodiment of the present disclosure, the second electronic device 200 may provide feedback corresponding to a normal playing pattern and an error pattern of the user.

According to an embodiment of the present disclosure, the third electronic device 300 may be a wearable electronic device such as a smart watch and smart glasses. According to an embodiment of the present disclosure, the third electronic device 300 may receive the playing result, the playing pattern, and the feedback of the user from the second electronic device 200 and may provide the playing result, the playing pattern, and the feedback of the user to the user.

According to an embodiment of the present disclosure, the server 400 may store sheet music data, a normal playing pattern, and an error pattern in the form of a database. For example, the server 400 may analyze, for example, a finger number for playing each pitch, a finger position, a string number, a rhythm, the number of times each finger is used, the number of times each string is played, a bow playing direction, a bow playing velocity, a fingering order, a string playing order, a bow playing order, a finger playing style (or a left hand playing style), a bow playing style (or a right hand playing style), and the like from sheet music data on a specific unit (e.g., on a measure basis or on a multiple measure unit), may classify the sheet music data for each similar playing pattern, and may store the classified normal playing patterns in a normal playing pattern database. According to an embodiment of the present disclosure, if analyzing a new playing pattern, the server 400 may update the normal playing pattern database stored therein. For example, the server 400 may compare, for example, playing data by a plurality of users with sheet music data to determine a portion where an error occurs in playing, may analyze the portion, where the error occurs, on a specific unit (e.g., on a measure unit), may classify the portion, where the error occurs, for each similar error pattern, and may store the classified error patterns in an error pattern database. According to an embodiment of the present disclosure, if analyzing a new error pattern, the server 400 may update the error pattern database stored therein.

According to an embodiment of the present disclosure, the server 400 may receive and store at least one of playing data, a playing result, a normal playing pattern, or an error pattern of the user from the second electronic device 200. The server 400 may store playing data, a playing result, a normal playing pattern, an error pattern, a generation frequency of the error pattern for each user. According to an embodiment of the present disclosure, the server 400 may send at least one of a playing result, a normal playing pattern, or an error pattern according to old playing data of the user to the second electronic device 200 according to a request of the second electronic device 200.

Figure 2A:
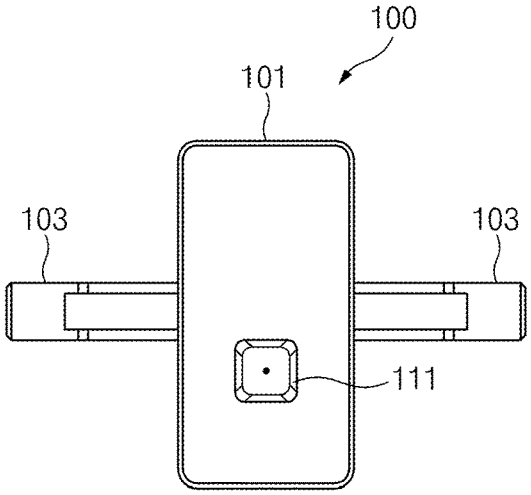
FIGS. 2A to 2C are drawings illustrating a structure of a first electronic device according to various embodiments of the present disclosure.
Figure 2B:
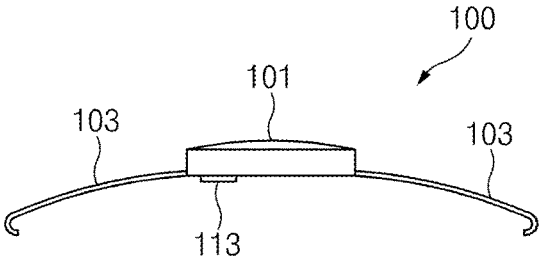
Figure 2C:
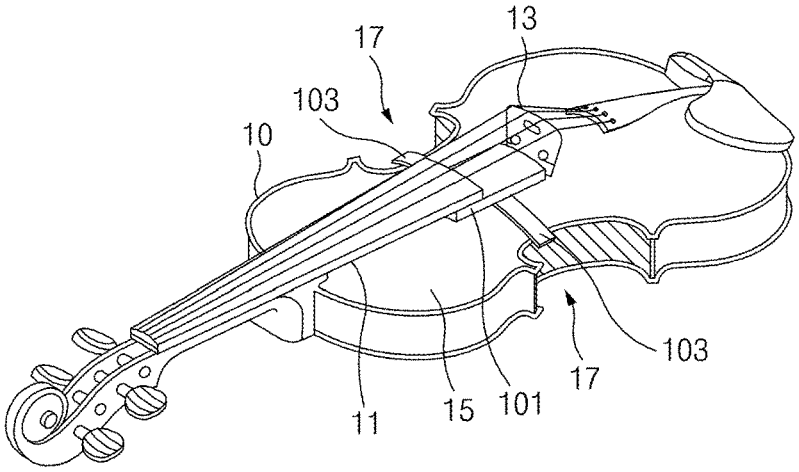

FIGS. 2A to 2C are drawings illustrating a structure of a first electronic device according to various embodiments of the present disclosure.

FIG. 2A illustrates a top view of a first electronic device 100. Referring to FIG. 2A, the first electronic device 100 may include a body part 101 and a coupling part 103. According to an embodiment of the present disclosure, the coupling part 103 may be extended from both directions of the body part 101. According to an embodiment of the present disclosure, the body part 101 may include an image sensor on its upper surface.

FIG. 2B illustrates a front view of the first electronic device 100. Referring to FIG. 2B, the coupling part 103 may be extended from both the directions of the body part 101, and each of both ends of the coupling part 103 may have a bent shape in a direction of the body part 101. According to an embodiment of the present disclosure, the body part 101 may include a vibration sensor 113 on its lower surface. The first electronic device 100 may be attached to a string instrument 10 in a form in which the lower surface of the body part 101 is faced with the string instrument 10. Therefore, the vibration sensor 113 may be in direct contact with the string instrument 10.

FIG. 2C is a perspective view of a state in which the first electronic device 100 is attached to the string instrument 10. Referring to FIG. 2C, the body part 101 may be attached between a fingerboard 11 and a bridge 13. According to an embodiment of the present disclosure, a part of the body part 101 of the first electronic device 100 may be attached between the fingerboard 11 of the string instrument 10 and a top 15 of the string instrument 10. According to an embodiment of the present disclosure, the coupling part 103 is coupled to a c-bout 17 of the string instrument 10 and may fix the first electronic device 100 to the string instrument 10.

Figure 3A:
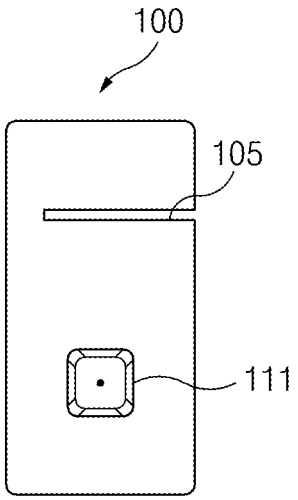
FIGS. 3A to 3C are drawings illustrating a structure of a first electronic device according to various embodiments of the present disclosure.
Figure 3B:
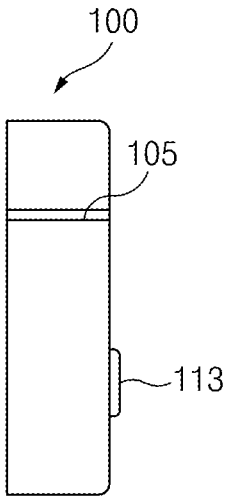
Figure 3C:
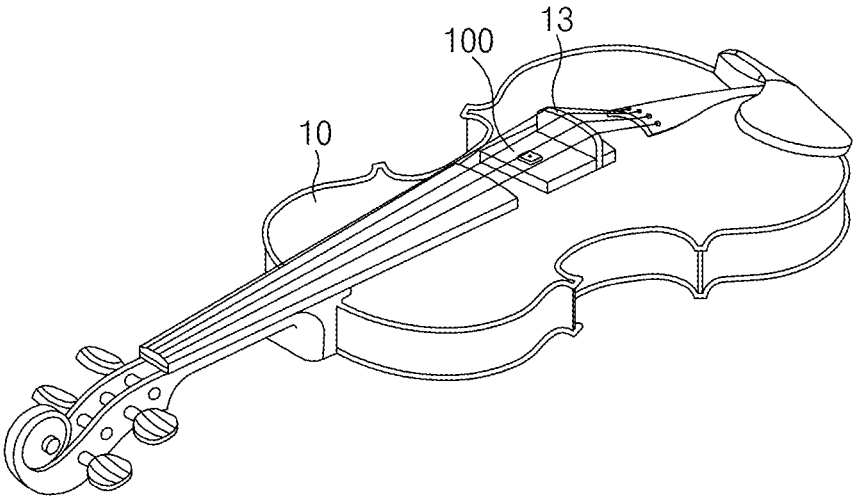

FIGS. 3A to 3C are drawings illustrating a structure of a first electronic device according to various embodiments of the present disclosure.

FIG. 3A illustrates a top view of a first electronic device 100. Referring to FIG. 3A, the first electronic device 100 may include a linear-shaped slit 105 in its one side. According to an embodiment of the present disclosure, the slit 105 may be formed towards an opposite side from the one side. According to an embodiment of the present disclosure, a body part 101 of FIG. 2A may include an image sensor 111 on its upper surface.

FIG. 3B illustrates a side view of the electronic device 100. Referring to FIG. 3B, according to an embodiment of the present disclosure, the first electronic device 100 may include a vibration sensor 113 on its lower surface. The first electronic device 100 may be attached to a string instrument 10 in a form in which a lower surface of the first electronic device 100 is faced with the string instrument 10. Therefore, the vibration sensor 113 may be in direct contact with the string instrument 10.

FIG. 3C illustrates a perspective view of a state in which the first electronic device 100 is attached to the string instrument. Referring to FIG. 3C, the first electronic device 100 may be attached to the string instrument 10 in a form in which a bridge 13 of the string instrument 10 is inserted into the slit 105 of the first electronic device 100.

Figure 4:
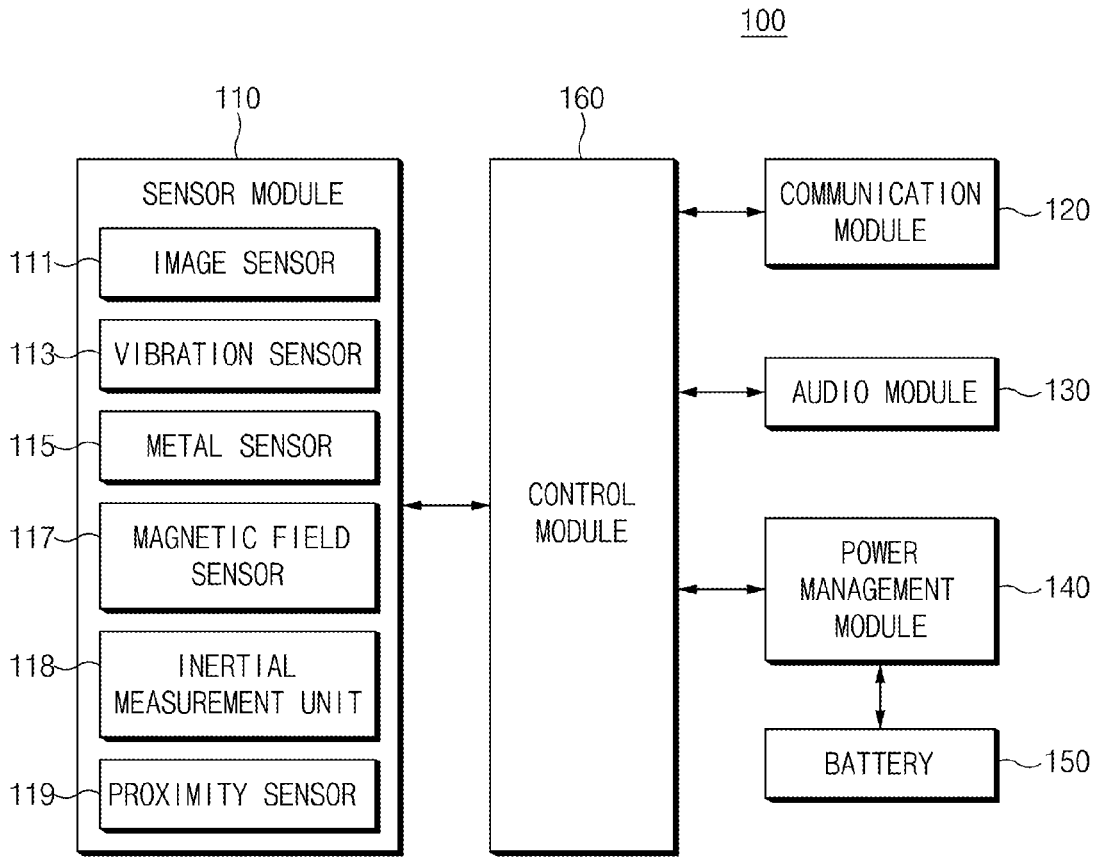
FIG. 4 is a block diagram illustrating a configuration of a first electronic device according to an embodiment of the present disclosure.

FIG. 4 is a block diagram illustrating a configuration of a first electronic device according to an embodiment of the present disclosure.

Referring to FIG. 4, a first electronic device 100 may include a sensor module 110, a communication module 120, an audio module 130, a power management module 140, a battery 150, and a control module 160.

According to an embodiment of the present disclosure, the sensor module 110 may sense a motion of a bow to a string instrument (e.g., the bow 20 of FIG. 1 to the string instrument 10 of FIG. 1) and may sense a vibration generated by the string instrument 10. According to various embodiments of the present disclosure, the sensor module 110 may include an image sensor 111, a vibration sensor 113, a metal sensor 115, a magnetic field sensor 117, an inertia measurement unit 118, and a proximity sensor 119.

According to an embodiment of the present disclosure, the image sensor 111 may sense a motion of the bow 20 to the string instrument 10. According to an embodiment of the present disclosure, the image sensor 111 may be located on an upper surface of the first electronic device 100 and may sense an infrared image of the bow 20 located between a fingerboard 11 and a bridge 13 of the string instrument 10. According to an embodiment of the present disclosure, the image sensor 111 may send an infrared signal, may receive an infrared signal reflected from the bow 20 (or bow hairs), and may generate an infrared image.

According to an embodiment of the present disclosure, the image sensor may be implemented with an array image sensor (or a two-dimensional (2D) image sensor). For example, the image sensor 111 may sense a 2D region between the fingerboard 11 and the bridge 13 of the string instrument 10.

Figure 5A:
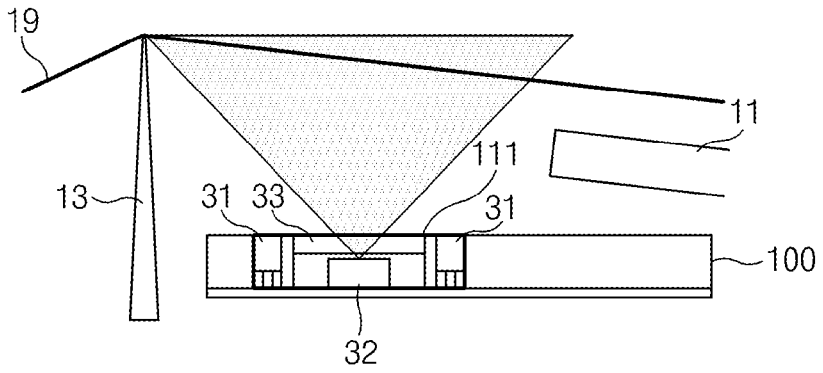
FIGS. 5A to 5C are drawings illustrating a structure and a viewing angle of an image sensor according to various embodiments of the present disclosure.
Figure 5B:
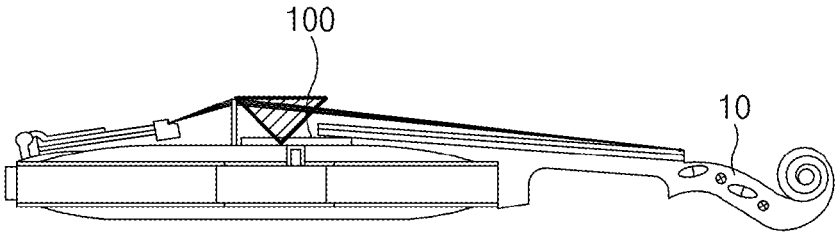
Figure 5C:
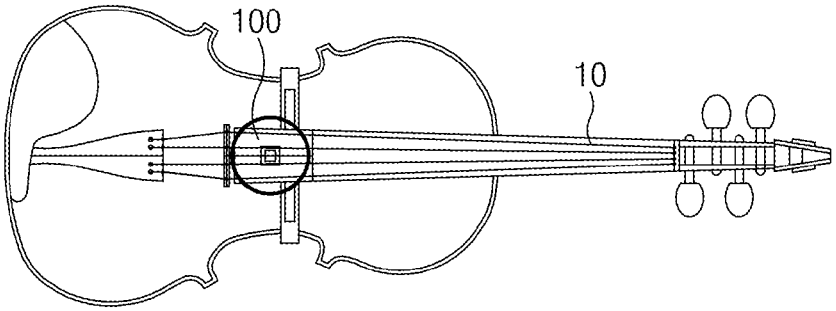

FIGS. 5A to 5C are drawings illustrating a structure and a viewing angle of an image sensor according to various embodiments of the present disclosure.

FIG. 5A illustrates a lateral cutting surface of a first electronic device 100 in a state in which the first electronic device 100 is attached to a string instrument. Referring to FIG. 5A, an image sensor 111 may be located between a fingerboard 11 and a bridge 13 of the string instrument and may generate a 2D infrared image in an upper direction of the image sensor 111. According to an embodiment of the present disclosure, the image sensor 111 may include transmit modules 31, a receive module 32, and an infrared filter 33. Each of the transmit modules 31 may transmit an infrared signal. For example, each of the transmit modules 31 may include a light emitting diode (LED) module which generates the infrared signal. According to an embodiment of the present disclosure, the transmit modules 31 may be located at both outer sides of the image sensor 111. The receive module 32 may receive an infrared signal reflected from a bow (e.g., bow 20 of FIG. 1) (or bow hairs) among infrared signals transmitted from the transmit modules 31. According to an embodiment of the present disclosure, the receive module 32 may be located in the center of the image sensor 111. According to an embodiment of the present disclosure, the receive module 32 may include a photodiode which may detect an infrared signal. The photodiode may be two-dimensionally disposed in the receive module 32. According to an embodiment of the present disclosure, the infrared filter 33 may be located at an upper side of the receive module 32, and may pass only an infrared signal among signals input to the image sensor 111 and may filter the other signals (e.g., visible rays). Therefore, the receive module 32 may receive only the infrared signal.

FIGS. 5B and 5C illustrate viewing angles of the image sensor 111 from a lateral surface and an upper surface of the first electronic device 100. Referring to FIGS. 5B and 5C, the image sensor 111 may have a viewing angle in the form of spreading in an upper direction. Therefore, the image sensor 111 may sense a region including strings 19 between the fingerboard 11 and the bridge 13 to sense a motion of the bow 20 which is in contact with the strings 19 between the fingerboard 11 and the bridge 13.

According to an embodiment of the present disclosure, the image sensor 111 may be implemented with a line image sensor. For example, the line image sensor may sense a line in the direction of strings 19 of the string instrument. According to an embodiment of the present disclosure, the line image sensor may sense a plurality of lines (e.g., two lines) in the direction of the strings 19 of the string instrument 10.

Figure 6A:
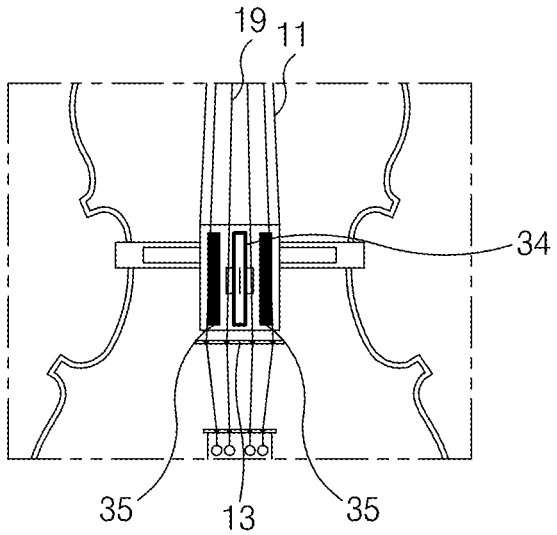
FIGS. 6A and 6B are drawings illustrating a structure and a viewing angle of an image sensor according to various embodiments of the present disclosure.
Figure 6B:
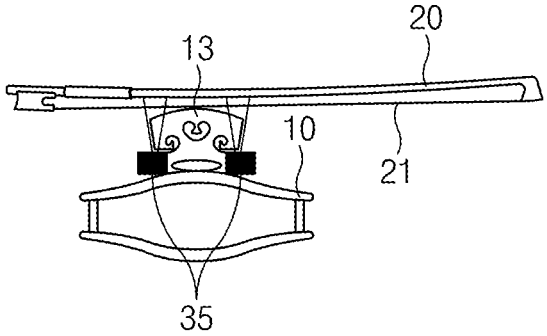

FIGS. 6A and 6B are drawings illustrating a structure and a viewing angle of an image sensor according to various embodiments of the present disclosure.

FIG. 6A illustrates a top view of a first electronic device 100 in a state in which the first electronic device 100 is attached to a string instrument. Referring to FIG. 6A, an image sensor 111 of FIG. 4 may be located between a fingerboard 11 and a bridge 13 of the string instrument and may generate a one-dimensional (1D) infrared image in an upper direction of the image sensor 111. According to an embodiment of the present disclosure, the image sensor 111 may include a transmit module 34 and receive modules 35. The transmit module 34 may transmit an infrared signal. For example, the transmit module 34 may include an LED module which generates the infrared signal. According to an embodiment of the present disclosure, the transmit module 34 may be located in the center of the image sensor 111 in the form of a line in the direction of strings 19. Each of the receive modules 35 may receive an infrared signal reflected from a bow among infrared signals transmitted from the transmit module 34. According to an embodiment of the present disclosure, the receive modules 35 may be located at left and right sides of the transmit module 34. According to an embodiment of the present disclosure, each of the receive module 35 may include a photodiode which may detect an infrared signal. The photodiode may be one-dimensionally disposed in the direction of the strings 19 in each of the receive modules 35. According to an embodiment of the present disclosure, each of the receive modules 35 may include a low pass filter. Each of the receive module 35 may filter the other signals (e.g., visible rays) except for an infrared signal from an analog signal detected by the photodiode using the low pass filter.

FIG. 6B illustrates a viewing angle of the image sensor 111 from a front surface of the electronic device 100. Referring to FIG. 6B, the image sensor 111 may have a viewing angle in the form of spreading in an upper direction. Therefore, the image sensor 111 may sense two lines in the direction of the strings to sense a motion of a pattern of bow hairs 21 of a bow 20 which is in contact with the strings between the fingerboard 11 and the bridge 13.

According to an embodiment of the present disclosure, a sensor module 110 of FIG. 4 may include the image sensor 111 which senses an infrared image in a side direction of the first electronic device 100.

Figure 7:
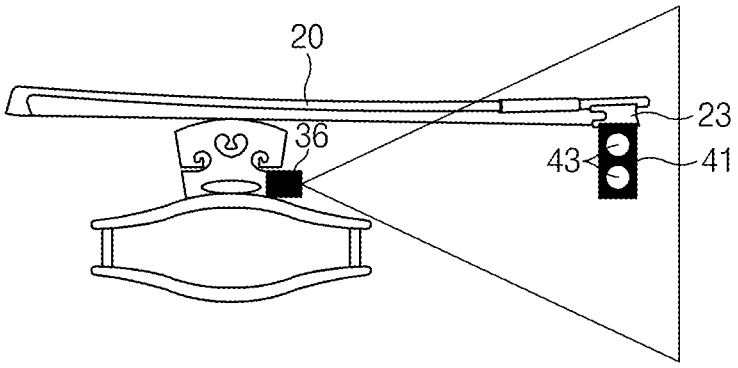
FIG. 7 is a drawing illustrating a viewing angle of a side image sensor according to an embodiment of the present disclosure.

FIG. 7 is a drawing illustrating a viewing angle of a side image sensor according to an embodiment of the present disclosure.

Referring to FIG. 7, a side image sensor 111 of FIG. 4 may include a receive module 36. The receive module 36 may receive an infrared signal transmitted from a frog 23 of a bow 20. According to an embodiment of the present disclosure, the bow 20 may include a transmit module 41 which transmits an infrared signal. According to an embodiment of the present disclosure, the transmit module 41 may be located on the frog 23. According to an embodiment of the present disclosure, the transmit module 41 may include at least one LED which generates an infrared signal. For example, the transmit module 41 may include two LEDs 43 disposed in a longitudinal direction on the frog 23. According to an embodiment of the present disclosure, the receive module 36 may include a photodiode which may detect an infrared signal. The photodiode may be two-dimensionally disposed in the receive module 36. Although not illustrated in FIG. 7, the side image sensor 111 may include an infrared filter. The infrared filter may pass only an infrared signal among signals input to the side image sensor 111 and may filter the other signals (e.g., visible rays). The receive module may receive only the infrared signal.

According to an embodiment of the present disclosure, the side image sensor 111 may include a transmit module which transmits an infrared signal. If the side image sensor 111 includes the transmit module, the LEDs 43 located on the frog 23 may be implemented with a reflector which reflects an infrared signal. Therefore, the receive module 36 may receive an infrared signal reflected from the reflector located on the frog 23 among infrared signals transmitted from the transmit module. If the reflector is attached to the frog 23, a weight of the bow 20 is distributed and a change of the entire weight of the bow 20 is inconsequential. However, compared with attaching the LEDs 43 with the frog 23, since an amount of signals transmitted from the first electronic device 100 is increased, power consumption of the first electronic device 100 may be increased.

A vibration sensor 113 of FIG. 4 may sense a vibration (or a sound) generated by a string instrument 10 of FIG. 1. The vibration sensor 113 may include a piezo sensor. The vibration sensor 113 may sense a vibration generated by the string instrument 10 and may convert the sensed vibration into an electric signal.

A metal sensor (e.g., 115 of FIG. 4) may sense a metal located around a first electronic device 100 of FIG. 4. According to an embodiment of the present disclosure, the metal sensor 115 may sense a motion of a metal (e.g., aluminum) attached to a stick. For example, a coil included in the metal sensor 115 may generate an impedance change by motion of the meal attached to the stick. The metal sensor 115 may sense the impedance change of the coil. According to an embodiment of the present disclosure, the metal sensor 115 may sense a plurality of regions (e.g., two regions) spaced apart from each other at a predetermined interval. According to an embodiment of the present disclosure, the sensor module 110 may include a plurality of metal sensors 115. The plurality of metal sensors 115 may be spaced apart from each other at a predetermined interval and may sense different regions. According to an embodiment of the present disclosure, the metal sensor 115 may include a plurality of coils which may be spaced apart from each other at a predetermined interval and may sense different regions.

According to an embodiment of the present disclosure, a magnetic field sensor 117 of FIG. 4 may sense a change of a magnetic field around the first electronic device 100. According to an embodiment of the present disclosure, the magnetic field sensor 117 may sense a change of a magnetic field by a motion of a magnet attached to a stick.

An inertial measurement unit (e.g., 118 of FIG. 4) may sense a motion of the string instrument 10. According to an embodiment of the present disclosure, the inertial measurement unit 118 may include an acceleration sensor and a gyro sensor. The acceleration sensor may sense acceleration of the string instrument 10. For example, the acceleration sensor may sense the acceleration of the string instrument 10 and may output an acceleration value of the string instrument 10 in directions of three axes (e.g., an x-axis, a y-axis, and a z-axis). The gyro sensor may sense a rotational angular velocity of the string instrument 10. For example, the gyro sensor may sense an angular velocity of the string instrument 10 and may output the angular velocity of the string instrument 10 in the directions of three axes (e.g., the x-axis, the y-axis, and the z-axis).

A proximity sensor (e.g., 119 of FIG. 4) may determine whether an object is approached within a specific distance. For example, the proximity sensor 119 may sense a region between a fingerboard 11 and a bridge 13 of the string instrument 10 and may determine whether the bow 20 is in contact with a string.

A communication module (e.g., 120 of FIG. 4) may communicate with a second communication device 200 of FIG. 1. For example, the communication module 120 may communicate with the second electronic device 200 using local-area wireless communication technologies such as Bluetooth, NFC, and Zigbee. According to an embodiment of the present disclosure, the communication module 120 may send playing data to the second electronic device 200. If the inertial measurement unit 118 is attached to the bow 20, the communication module 120 may receive information about a motion of the bow 20 from an electronic device attached to the bow 20.

An audio module (e.g., 130 of FIG. 4) may generate, for example, an audio signal. According to an embodiment of the present disclosure, the audio module 130 may generate an audio signal using a vibration of the string instrument 10, which is sensed by the vibration sensor 113. The audio module 130 may output an audio signal through an audio interface which may connect with a speaker or an earphone (or a headphone). According to an embodiment of the present disclosure, the audio module 130 may provide a sound effect (e.g., a sense of sound field, distortion, and the like) to an audio signal through a reverberation calculation, a delay calculation, and an equalizer calculation.

A power management module (e.g., 140 of FIG. 4) may manage power of the electronic device 100. For example, the power management module 140 may supply power to components of the electronic device 100 using a battery 150 of FIG. 4 or may block power supplied to the components of the first electronic device 100. According to an embodiment of the present disclosure, the power management module 140 may include a power management integrated circuit (PMIC). According to an embodiment of the present disclosure, the power management module 140 may measure the remaining capacity of the battery 150 and voltage, current, or temperature of the battery 150 while the battery 150 is charged. According to an embodiment of the present disclosure, the battery 150 may include, for example, a rechargeable battery and/or a solar battery. According to an embodiment of the present disclosure, if an amount of light measured by the image sensor 111 is less than a predetermined reference value, the power management module 140 may block power supplied to the sensor module 110.

According to an embodiment of the present disclosure, a control module (e.g., 160 of FIG. 4) may analyze a motion of the bow 20 and a vibration of the string instrument 10, which are sensed by the sensor module 110, and may generate playing data. The playing data may include, for example, at least one of a pitch, a sound intensity, a rhythm, a longitudinal position of the bow 20, a lateral position of the bow 20, a relative tilt between the bow 20 and a string, a skewness of the bow 20 in the direction of a fingerboard, an inclination of the bow 20 in the direction of a body of the string instrument 10, a type of a string with which the bow 20 makes contact, a fingering position of the user, or velocity of the bow 20.

Figure 8:
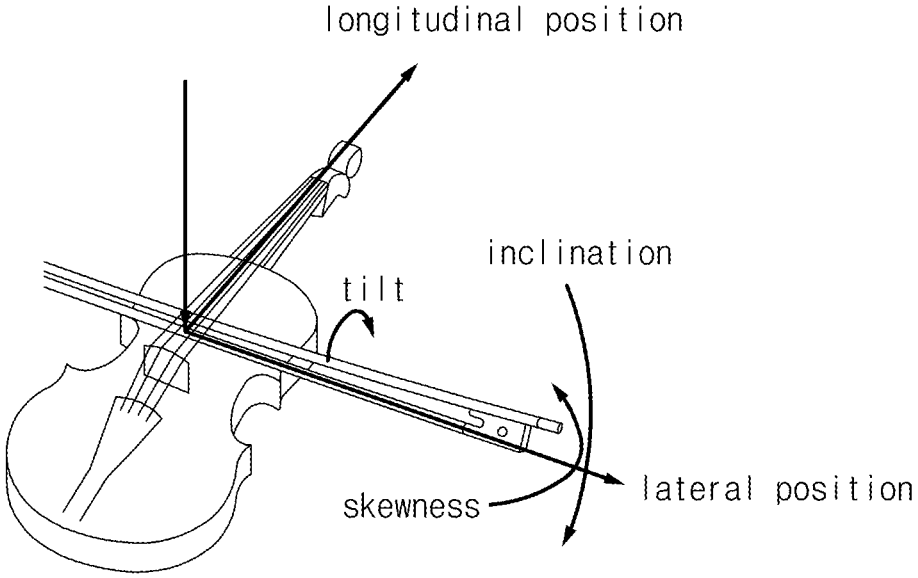
FIG. 8 is a drawing illustrating elements of determining a position and a posture of a bow according to an embodiment of the present disclosure.

FIG. 8 is a drawing illustrating elements of determining a position and a posture of a bow according to an embodiment of the present disclosure.

Referring to FIG. 8, when a user plays the string instrument, a position and a posture of a bow may be determined by a longitudinal position of the bow with respect to a string, a lateral position of the bow, a relative tilt between the bow and the string, a skewness of the bow in the direction of a fingerboard, an inclination of the bow in the direction of a body of the string instrument.

According to an embodiment of the present disclosure, a control module (e.g., 160 of FIG. 4) may determine the longitudinal position of the bow, the skewness of the bow in the direction of the fingerboard, the inclination of the bow in the direction of the body of the string instrument, and the velocity of the bow using a sensing value of an image sensor 111 of FIG. 4. According to an embodiment of the present disclosure, the control module 160 may binarize an infrared image of the image sensor 111 and may determine the above-mentioned elements, that is, the longitudinal position of the bow, the skewness of the bow in the direction of the fingerboard, the inclination of the bow in the direction of the body of the string instrument, and the velocity of the bow using the binarized image.

Figure 9B:
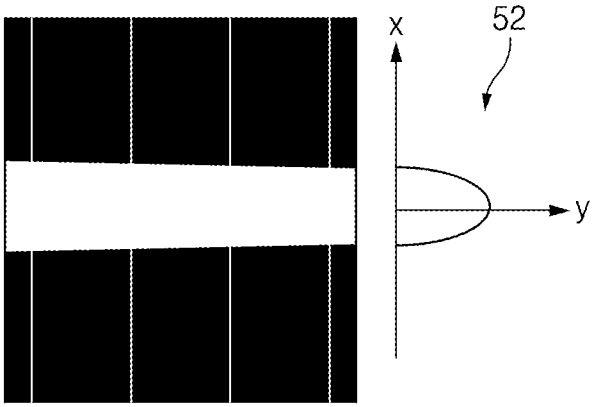
FIGS. 9A and 9B are drawings illustrating an infrared image generated by an image sensor according to various embodiments of the present disclosure.
Figure 9A:
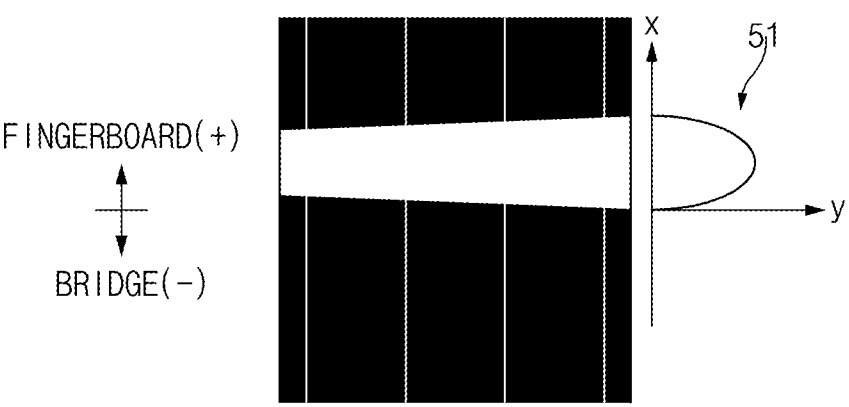

FIGS. 9A and 9B are drawings illustrating an infrared image generated by an image sensor according to various embodiments of the present disclosure.

According to an embodiment of the present disclosure, a control module (e.g., 160 of FIG. 4) may determine a longitudinal position using an infrared image of an array image sensor. Referring to FIGS. 9A and 9B, a region reflected from a bow may be indicated with a bright color on an infrared image, and a region which is not reflected from the bow may be indicated with a dark color on the infrared image. If an infrared image is projected in a horizontal direction (or a vertical direction of a string), as shown in a right side of the infrared image, graphs 51 and 52 indicating distribution of bright pixels may be obtained. In the graphs 51 and 52, an x-axis denotes a longitudinal position, and a y-axis denotes an accumulation value of bright pixels in a specific position. According to an embodiment of the present disclosure, the control module 160 may determine a point, where the accumulation value of the bright pixels is a maximum value, as a longitudinal position of the bow. For another example, the control module 160 may determine a point, corresponding to an average value of the bright pixels, as the longitudinal position of the bow.

According to an embodiment of the present disclosure, the control module 160 may indicate a longitudinal position of the bow relative to a middle point between a fingerboard and a bridge. According to an embodiment of the present disclosure, if the bow is close to the fingerboard, the longitudinal position of the bow may have a plus value. If the bow is close to the bridge, the longitudinal position of the bow may have a minus value. As shown in FIG. 9A, if the bow is slanted in the direction of the fingerboard, the control module 160 may determine a longitudinal direction of the bow as plus 10 mm. As shown in FIG. 9B, if the bow is located in the middle of the fingerboard and the bridge, the control module 160 may determine the longitudinal position of the bow as "0".

Figure 10A:
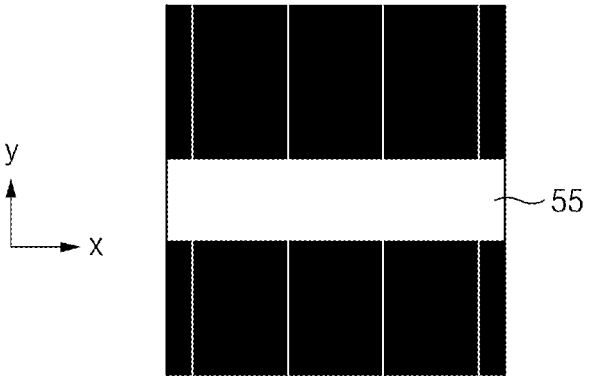
FIGS. 10A and 10B are drawings illustrating an infrared image generated by an image sensor according to various embodiments of the present disclosure.
Figure 10B:
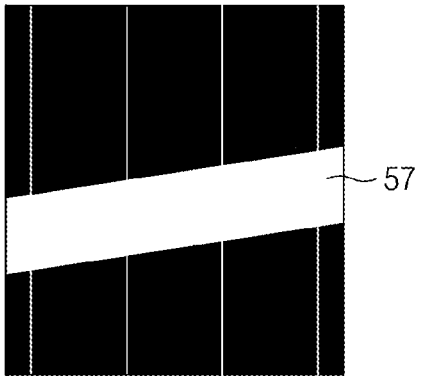
Figure 11A:
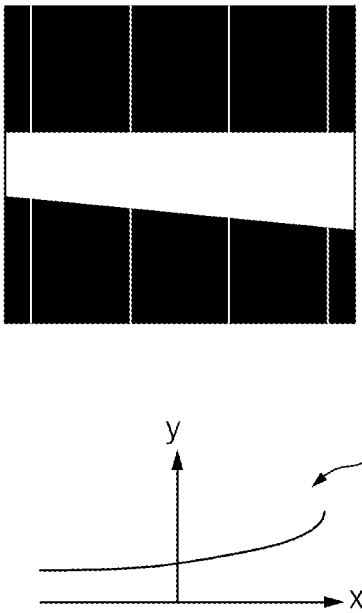
FIGS. 11A to 11D are drawings illustrating an infrared image generated by an image sensor according to various embodiments of the present disclosure.
Figure 11B:
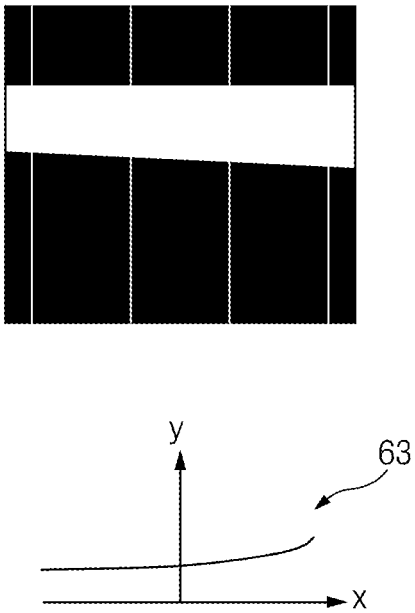
Figure 11C:
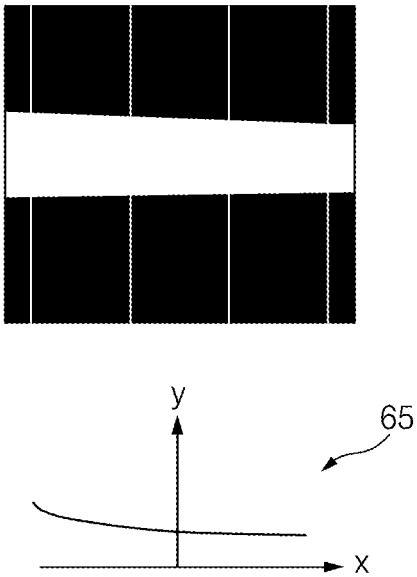
Figure 11D:
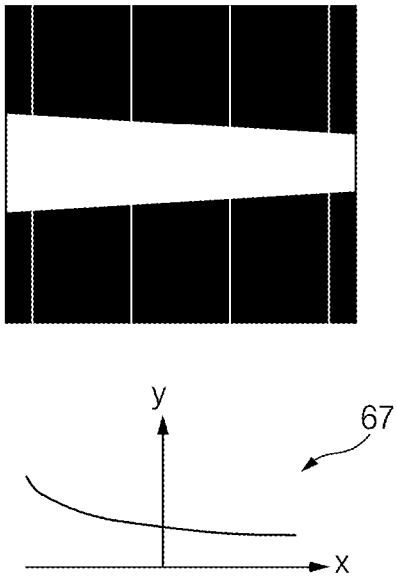

FIGS. 10A and 10B are drawings illustrating an infrared image generated by an image sensor according to various embodiments of the present disclosure.

According to an embodiment of the present disclosure, a control module (e.g., 160 of FIG. 4) may determine a skewness of a bow in the direction of a fingerboard using an infrared image of an array image sensor. Referring to FIGS. 10A and 10B, the control module 160 may determine an angle defined by a vertical direction of a string and the bow as a skewness of the bow in the direction of the fingerboard. According to an embodiment of the present disclosure, the control module 160 may determine central positions 55 and 57 of the bow in a vertical direction (e.g., an x-axis) of the string. According to an embodiment of the present disclosure, the control module 160 may determine an angle of a slope in each of the central positions 55 and 57 of the bow as a skewness of the bow in the direction of the fingerboard. As shown in FIG. 10, if the central position 55 of the bow in the vertical direction of the string is identical from a first string to a fourth string, the control module 160 may determine the skewness of the bow in the direction of the fingerboard as 0 degrees. As shown in FIG. 10B, if the central position 57 of the bow is higher when it heads from the fourth string to the first string, the control module 160 may determine the skewness of the bow in the direction of the fingerboard as plus 10 degrees.

FIGS. 11A to 11D are drawings illustrating an infrared image generated by an image sensor according to various embodiments of the present disclosure.

According to an embodiment of the present disclosure, a control module (e.g., 160 of FIG. 4) may determine an inclination of a bow in the direction of a body of a string instrument using an infrared image of an array image sensor. Referring to FIGS. 11A to 11D, a region reflected from the bow may be indicated with a bright color on an infrared image, and a region which is not reflected from the bow may be indicated with a dark color on the infrared image. According to an embodiment of the present disclosure, a thickness of the bow, indicated on the infrared image in a vertical direction of a string, may be changed. For example, although the bow has the same thickness, the bow may be thicker when it is closer to an image sensor (e.g., 111 of FIG. 4), according to a perspective. The bow may be thinner when it is more distant from the image sensor 111, according to the perspective. If an infrared image is projected in a vertical direction (or a horizontal direction of a string), as shown in a lower side of the infrared image, graphs 61 to 67 indicating distribution of bright pixels may be obtained. An x-axis of each of the graphs 61, 63, 65 and 67 denotes a position of the vertical direction of the string, and a y-axis of each of the graphs 61 to 67 denotes an accumulation value of bright pixels in a specific position. According to an embodiment of the present disclosure, the control module 160 may determine a slope of the accumulation value of the bright pixels using the graphs 61 to 67. The control module 160 may determine an inclination of the bow in the direction of the body of the string instrument according to the determined slope value.

According to an embodiment of the present disclosure, the control module 160 may determine a lateral position of the bow using an infrared image of an array image sensor. For example, the control module 160 may determine a lateral position of the bow and velocity (e.g., a direction and a speed) of the bow using a pattern of bow hairs included in an infrared image.

Figure 12A:
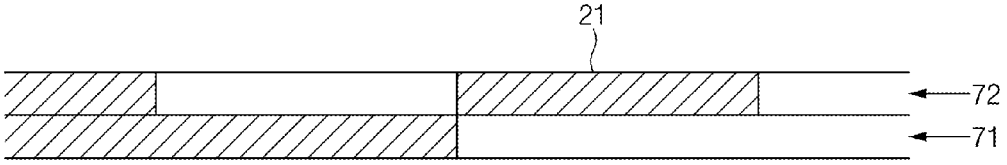
FIGS. 12A and 12B are drawings illustrating a pattern of bow hairs according to various embodiments of the present disclosure.
Figure 12B:
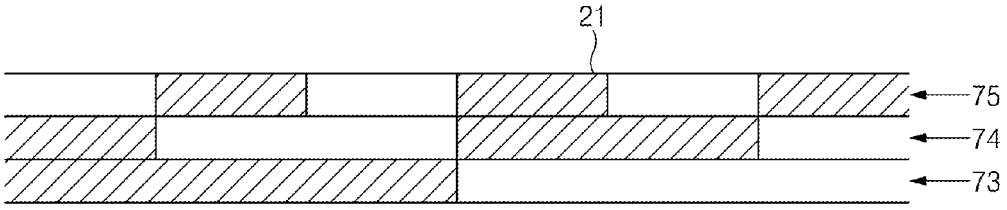

FIGS. 12A and 12B are drawings illustrating a pattern of bow hairs according to various embodiments of the present disclosure.

A pattern of bow hairs 21 may be formed by dyeing some of the bow hairs 21 with a color (e.g., a black color) contrasted with a basic color (e.g., a white color) of the bow hairs 21. Referring to FIG. 12A, the bow hairs 21 included in a bow may be divided into two lines 71 and 72 in the direction of the bow. The two lines 71 and 72 may have different patterns. For example, the first line 71 may be divided into two equal parts, and one part of the first line 71 may be dyed with the black color. The second line 72 may be divided into 4 equal parts, and a pattern may be formed to repeat the black color and the white color. Referring to FIG. 12B, the bow hairs 21 included in the bow may be divided into three lines 73, 74, and 75 in the direction of the bow. The three lines 73-75 may have different patterns. For example, the first line 73 may be divided into two equal parts, and one part of the first line 73 may be dyed with the black color. The second line 74 may be divided into four equal parts, and a pattern may be formed to repeat the black color and the white color. The third line 75 may be divided into eight equal parts, and a pattern may be formed to repeat the black color and the white color.

According to an embodiment of the present disclosure, a control module (e.g., 160 of FIG. 4) may analyze a pattern of a plurality of lines included in the bow hairs 21 and may recognize a lateral position of the bow. According to an embodiment of the present disclosure, when the number of lines included in the bow hairs 21 are increased, accuracy of a lateral position of the bow may be improved. According to an embodiment of the present disclosure, the control module 160 may analyze a change of the pattern of the plurality of lines included in the bow hairs 21 and may determine whether the bow moves in the direction of its head or the direction of its frog. According to an embodiment of the present disclosure, the control module 160 may determine a speed at which the bow moves, using a change in velocity of the pattern of the plurality of lines included in the bow hairs 21.

FIGS. 13A to 13D are drawings illustrating an infrared image generated by an image sensor according to various embodiments of the present disclosure.

According to an embodiment of the present disclosure, a control module (e.g., 160 of FIG. 4) may determine a skewness of a bow in the direction of a fingerboard and an inclination of the bow in the direction of a body of a string instrument using an infrared image of a line image sensor. An infrared image generated from the line image sensor may include, for example, as shown in FIGS. 13A to 13D, two lines in a horizontal direction of a string.

Figure 13A:
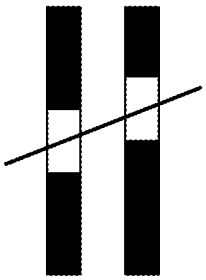
FIGS. 13A to 13D are drawings illustrating an infrared image generated by an image sensor according to various embodiments of the present disclosure.
Figure 13B:
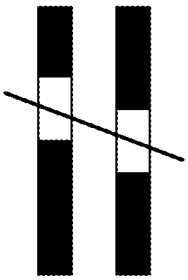

Referring to FIGS. 13A and 13B, a region reflected from the bow may be indicated with a bright color on an infrared image, and a region which is not reflected from the bow may be indicated with a dark color on the infrared image. The control module 160 may determine a central position of bright pixels with respect to each of two lines. The control module 160 may determine a skewness of the bow in the direction of the fingerboard using a distance between the two lines and a distance between two central positions. For example, the control module 160 may determine a skewness of the bow in the direction of the fingerboard as plus 10 degrees with respect to an image shown in FIG. 13A and determine a skewness of the bow in the direction of the fingerboard as minus 10 degrees with respect to an image shown in FIG. 13B.

Figure 13C:
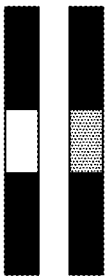
Figure 13D:
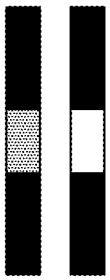

Referring to FIGS. 13C and 13D, an amount of light of an infrared signal received in an image sensor 111 of FIG. 4 may be changed according to a distance between the image sensor 111 and the bow. In other words, when the bow is closer to the image sensor 111, it may be displayed to be brighter on an infrared image. When the bow is more distant from the image sensor 111, it may be displayed to be darker on the infrared image. For one example, if a head of the bow is closer to the image sensor 111 than a frog of the bow, as shown in FIG. 13C, the bow displayed on a left image is displayed to be bright, and the bow displayed on a right image may be displayed to be dark. For another example, if the frog of the bow is closer to the image sensor 111 than the head of the bow, as shown in FIG. 13D, the bow displayed on a right image is displayed to be bright, and the bow displayed on a left image may be displayed to be dark. According to an embodiment of the present disclosure, the control module 160 may determine an inclination of the bow in the direction of the body of the string instrument using brightness (or bright difference) of pixels included in the line image sensor.

FIGS. 14A to 14H are drawings illustrating an infrared image generated by an image sensor according to various embodiments of the present disclosure.

According to an embodiment of the present disclosure, a control module (e.g., 160 of FIG. 4) may determine a skewness of a bow in the direction of a fingerboard, an inclination of the bow in a body of a string instrument, and a lateral position of the bow using an infrared image of a side image sensor. An infrared image generated from the side image sensor may include, for example, as shown in FIGS. 14A to 14F, a plurality of points (e.g. two points) included in a 2D image. As described with reference to FIG. 7, the plurality of points may be an infrared signal received from a transmit module 41 attached to a frog 23 or an infrared signal reflected from a reflector attached to the frog 23.

Figure 14A:
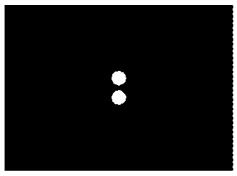
FIGS. 14A to 14H are drawings illustrating an infrared image generated by an image sensor according to various embodiments of the present disclosure.
Figure 14B:
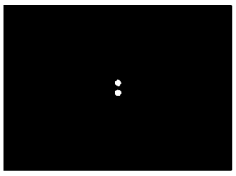

According to an embodiment of the present disclosure, the control module 160 may determine a lateral position of the bow using a distance between the plurality of points included in the infrared image or a size of each of the plurality of points. Referring to FIG. 14A, for example, if a distance between two points is distant from each other or if each of the two points is large, the control module 160 may determine that the bow is close to a string instrument. Referring to FIG. 14B, if a distance between two points is close to each other or if each of the two points is small, the control module 160 may determine that the bow is relatively distant from the string instrument.

Figure 14C:
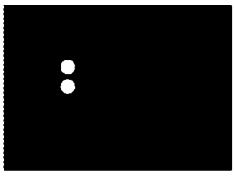
Figure 14D:
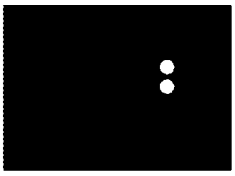

According to an embodiment of the present disclosure, the control module 160 may determine a skewness of the bow in the direction of the fingerboard using a transverse position of the plurality of points included in the infrared image. For example, the control module 160 may determine a skewness of the bow in the direction of the fingerboard using the transverse position of the plurality of points in a state in which a longitudinal position of the bow and a lateral position of the bow are determined. Referring to FIGS. 14C and 14D, for example, the control module 160 may determine a skewness of the bow in the direction of the fingerboard as plus 10 degrees with respect to an image shown in FIG. 14C and may determine a skewness of the bow in the direction of the fingerboard as minus 10 degrees with respect to an image shown in FIG. 14D.

Figure 14E:
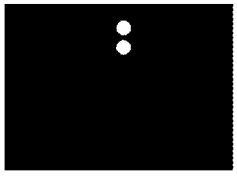
Figure 14F:
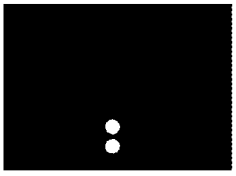
Figure 14G:
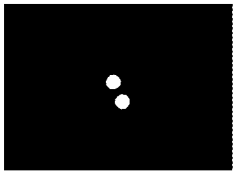
Figure 14H:
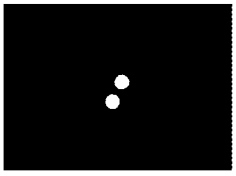

According to an embodiment of the present disclosure, the control module 160 may determine an inclination of the bow in the direction of the body of the string instrument using a longitudinal position of the plurality of points included in the infrared image. For example, the control module 160 may determine an inclination of the bow in the direction of the body using the longitudinal position of the plurality of points in a state in which the bow is in contact with a string and a lateral position of the bow is determined. Whether the bow is in contact with the string may be determined using a proximity sensor (e.g., 119 of FIG. 4). Referring to FIGS. 14E and 14F, for example, the control module 160 may determine an inclination of the bow in the direction of the body as plus 10 degrees with respect to an image shown in FIG. 14E and may determine an inclination of the bow in the direction of the body as minus 10 degrees with respect to an image shown in FIG. 14F According to an embodiment of the present disclosure, the control module 160 may determine a relative tilt between the bow and the string using a slope of the plurality of points included in the infrared image. For example, as shown in FIGS. 14A to 14E, a slope defined by the plurality of points is infinity (that is, if all bow hairs are in contact with the string), the control module 160 may determine a relative tilt between the bow and the string as 0 degree. Referring to FIG. 14G, if a slope defined by the plurality of points is a negative number, the control module 160 may determine that the bow is slanted in a right direction and may determine a relative tilt between the bow and the string as plus 20 degrees. Referring to FIG. 14H, if a slope defined by the plurality of points is a positive number, the control module 160 may determine that the bow is slanted in a left direction and may determine a relative tilt between the bow and the string as minus 20 degrees.

According to an embodiment of the present disclosure, the control module 160 may determine a velocity (e.g., a direction and a speed) of the bow using a sensing value of a metal sensor (e.g., 115 of FIG. 4).

Figure 15:
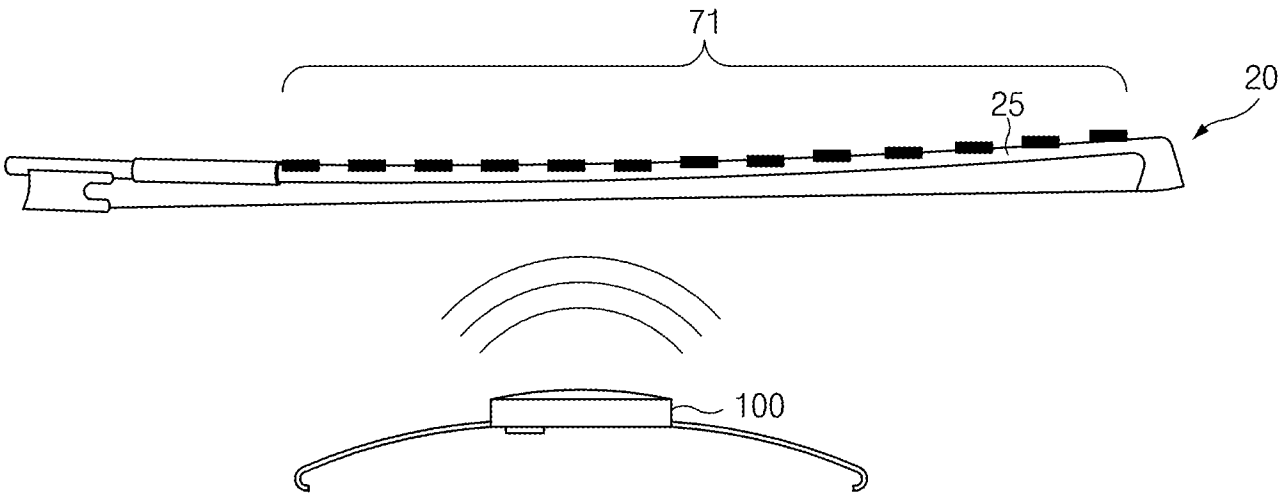
FIG. 15 is a drawing illustrating an attachment pattern of metals attached to a bow according to an embodiment of the present disclosure.

FIG. 15 is a drawing illustrating an attachment pattern of metals attached to a bow according to an embodiment of the present disclosure.

Referring to FIG. 15, a bow 20 may include metals 71 having a specific pattern. According to an embodiment of the present disclosure, the metals 71 may be attached to a stick 25. According to an embodiment of the present disclosure, the metals 71 may be attached to the stick 25 to have a periodic pattern. For example, the metals 71 may be attached to the stick 25 such that a region to which a metal material is attached and a region to which the metal material is not attached have a periodically repeated pattern along the stick 25. According to an embodiment of the present disclosure, a length of the region to which the metal material is attached and a length of the region to which the metal material is not attached may be set to be different from an interval between a plurality of regions (e.g., two regions) which may be sensed by a metal sensor (e.g., 115 of FIG. 4). According to an embodiment of the present disclosure, a control module (e.g., 160 of FIG. 4) may determine whether the bow 20 moves in the direction of its head or in the direction of its frog based on the plurality of regions which may be sensed by the metal sensor 115. According to an embodiment of the present disclosure, the control module 160 may determine a speed, at which the bow 20 moves, using a metal sensing period of the metal sensor 115.

According to an embodiment of the present disclosure, the control module 160 may determine a lateral position of the bow 20 and a velocity (e.g., a direction and a speed) of the bow 20 using a sensing value of a magnetic field sensor (e.g., 117 of FIG. 4).

Figure 16:
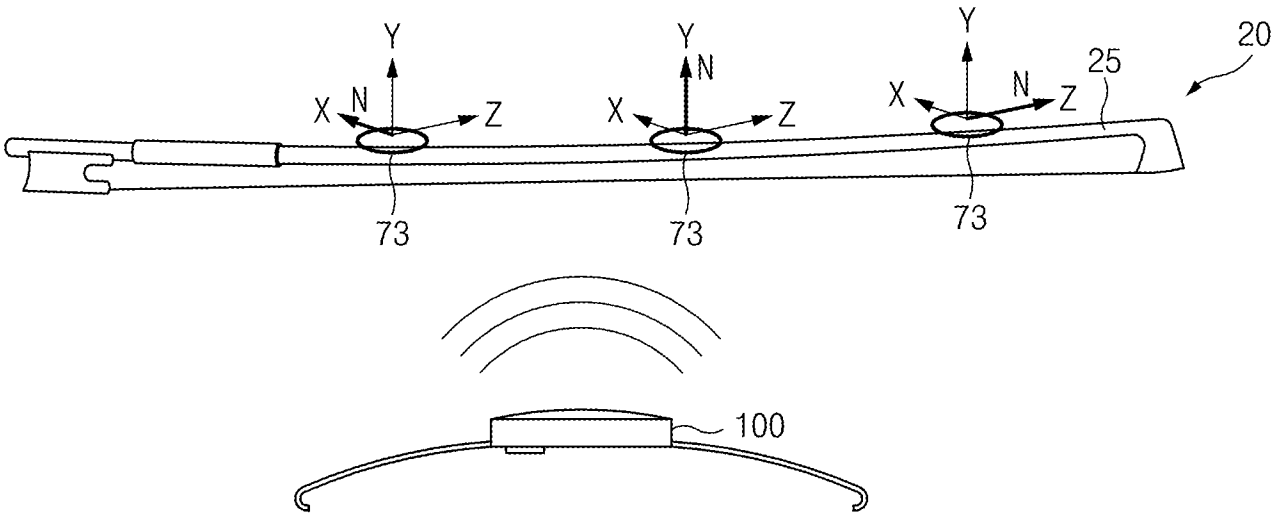
FIG. 16 is a drawing illustrating attachment positions of magnets attached to a bow according to an embodiment of the present disclosure.

FIG. 16 is a drawing illustrating attachment positions of magnets attached to a bow according to an embodiment of the present disclosure.

Referring to FIG. 16, a bow 20 may include at least one magnet 73. According to an embodiment of the present disclosure, the magnet 73 may be attached to a stick 25. According to an embodiment of the present disclosure, positions where the magnets 73 are attached may be determined according to the number of the magnets 73. For example, if the magnets 73 which are attached to the stick 25 are three, the three magnets 73 may be attached to positions where the entire length of the bow 20 is divided into four equal parts. According to an embodiment of the present disclosure, the at least one magnet 73 attached to the stick 25 may be disposed to have a different direction of a magnetic field. For example, if there are three magnets 73 attached to the stick 25, the three magnets 73 may be disposed such that the north poles head towards an x-axis, a y-axis, and a z-axis, respectively. A magnetic field formed by the three magnets 73 may be measured to be different according to a position of the stick 25. A control module (e.g., 160 of FIG. 4) may analyze a magnetic field sensed by a magnetic field sensor (e.g., 117 of FIG. 4) and may determine a lateral position of the bow 20. According to an embodiment of the present disclosure, the control module 160 may determine whether the bow 20 moves in the direction of its head or in the direction of its frog using a change of a magnetic field sensed by the magnetic field sensor 117. According to an embodiment of the present disclosure, the control module 160 may determine a speed, at which the bow 20 moves, using a change in velocity of a magnetic field sensed by the magnetic field sensor 117.

According to an embodiment of the present disclosure, the control module 160 may determine a longitudinal position of the bow 20, a lateral position of the bow 20, a relative tilt between the bow 20 and a string, a skewness of the bow 20 in the direction of a fingerboard, an inclination of the bow 20 in the direction of a body of a string instrument 10 of FIG. 1, and a velocity of the bow 20 using a motion of the string instrument 10, sensed by an inertial measurement unit (e.g., 118 of FIG. 4), and a motion of the bow 20, sensed by the inertial measurement sensor 118 attached to the bow 20.

According to an embodiment of the present disclosure, the control module 160 may determine a string, with which the bow 20 makes contact, using an inclination of the bow 20 in the direction of the body of the string instrument 10. For example, if an inclination of the bow 20 in the direction of the body of the string instrument 10 is included in a first range, the control module 160 may determine that the bow 20 is in contact with a first string. If the inclination of the bow 20 in the direction of the body of the string instrument 10 is included in a second range, the control module 160 may determine that the bow 20 is in contact with a second string. If the inclination of the bow 20 in the direction of the body of the string instrument 10 is included in a third range, the control module 160 may determine that the bow 20 is in contact with a third string. If the inclination of the bow 20 in the direction of the body of the string instrument 10 is included in a fourth range, the control module 160 may determine that the bow 20 is in contact with a fourth string.

According to an embodiment of the present disclosure, the control module 160 may analyze a vibration sensed by a vibration sensor (e.g., 160 of FIG. 4) and may determine a pitch, a sound intensity, and a rhythm. For example, the pitch may be determined by a frequency of the vibration. The sound intensity may be determined by amplitude of the vibration. The rhythm may be determined by timing at which the vibration is sensed.

According to an embodiment of the present disclosure, the control module 160 may enhance reliability of the determination of a pitch using information about a string with which the bow 20 makes contact. For example, a vibration sensed by the vibration sensor 113 may be a complex sound and may have a plurality of partial tones. The vibration may include a fundamental tone and harmonics having a frequency of integer times of the fundamental tone. If a vibration sensed by the vibration sensor 113 is transformed from a time domain to a frequency domain, a frequency corresponding to the fundamental tone may have the highest intensity (or the highest level). Therefore, the control module 160 may determine the frequency having the highest intensity as a pitch of the vibration. Herein, if the intensity of the harmonics is higher than that of the fundamental tone, an octave error in which the harmonics are determined as the fundamental tone. According to an embodiment of the present disclosure, the control module 160 may determine whether a pitch detected by a vibration is a pitch which may be generated by a string with which the bow 20 makes contact. In other words, the control module 160 may determine a pitch using a frequency component, which may be generated by a string with which the bow 20 makes contact, among a plurality of frequency components included in vibration. Therefore, the control module 160 may prevent an octave error which may be generated in a process of determining a pitch.

According to an embodiment of the present disclosure, the control module 160 may apply a window function when transforming a vibration sensed by the vibration sensor 113 from a time domain to a frequency domain to sense a pitch. For example, the control module 160 may filter only a vibration signal during a constant time necessary for determining a pitch of a vibration sensed by the vibration sensor 113 and may transform the vibration into the frequency domain. According to an embodiment of the present disclosure, the control module 160 may set a size of a time axis of the window function in a different way according to a type of a string with which the bow 20 makes contact. According to an embodiment of the present disclosure, when the bow 20 heads towards a string (e.g., a first string) corresponding to a high-pitched tone, the control module 160 may set a size of the time axis of the window function to be smaller. When the bow 20 heads towards a string (e.g., a fourth string) corresponding to a low-pitched tone, the control module 160 may set a size of the time axis of the window function to be bigger. Therefore, the control module 160 may reduce a time taken for determining a pitch and a data throughput.

According to an embodiment of the present disclosure, the control module 160 may determine a fingering position of a user according to a pitch and a string with which the bow 20 makes contact. The same pitch may be generated by a different string according to a fingering position of the user due to a characteristic of the string instrument 10. Therefore, if a fingering position of the user is determined using only a pitch, it may be impossible to determine an accurate fingering position. According to an embodiment of the present disclosure, the control module 160 may determine a fingering position of a string, with which the bow 20 makes contact, as a fingering position of the user among a plurality of fingering positions corresponding to a pitch. For example, if a pitch determined by the control module 160 is generated by a first string and a second string and if a string with which the bow 20 makes contact is the first string, the control module 160 may determine a position corresponding to the corresponding pitch as a finger position of the user in the first string. In other words, the control module 160 may determine a position, where a pitch is generated, as a fingering position of the user in a string with which the bow 20 makes contact. Therefore, although there are a plurality of fingering positions having the same pitch, the control module 160 may accurately determine a fingering position of the user.

Figure 17:
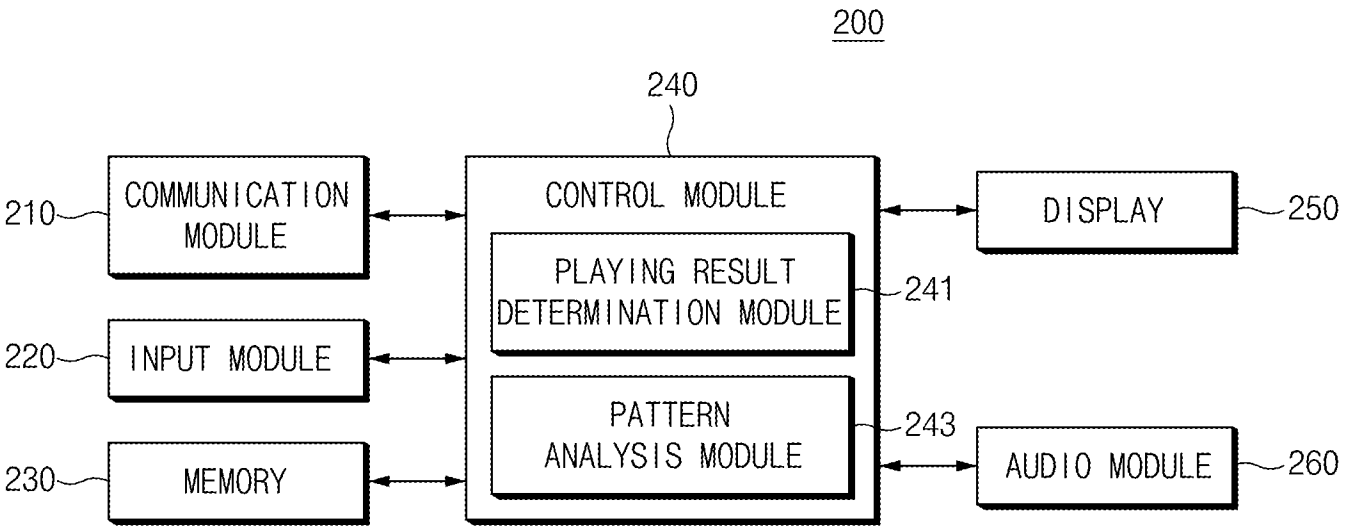
FIG. 17 is a block diagram illustrating a configuration of a second electronic device according to an embodiment of the present disclosure.

FIG. 17 is a block diagram illustrating a configuration of a second electronic device according to an embodiment of the present disclosure.

Referring to FIG. 17, a second electronic device 200 may include a communication module 210, an input module 220, a memory 230, a control module 240, a display 250, and an audio module 260.

The communication module 210 may communicate with a first electronic device 200, a third electronic device 300, and a server 400 of FIG. 1 The communication module 210 may communicate with, for example, the first electronic device 200 and the third communication device 300 using local-area wireless communication technologies such as Bluetooth, NFC, and Zigbee. The communication module 210 may communicate with the server 400 over an internet network or a mobile communication network.

According to an embodiment of the present disclosure, the communication module 210 may receive playing data of a user from the first electronic device 200. The playing data may include, for example, at least one of a pitch, a sound intensity, a rhythm, a longitudinal position of a bow, a lateral position of the bow, a relative tilt between the bow and a string, a skewness of the bow in the direction of a fingerboard, an inclination of the bow in the direction of a body of a string instrument, a type of a string with which the bow makes contact, a fingering position of the user, or a velocity of the bow.

According to an embodiment of the present disclosure, the communication module 210 may send playing data of the user, the user's playing result, the user's normal playing pattern, the user's error pattern, and a generation frequency of the error pattern to the server 400.

The input module 220 may receive a user operation. According to an embodiment of the present disclosure, the input module 220 may include a touch sensor panel for sensing a touch operation of the user, a pen sensor panel for sensing his or her pen operation, a gesture sensor (or a motion sensor) for recognizing his or her motion, and a voice sensor for recognizing his or her voice.

According to an embodiment of the present disclosure, the memory 230 may store playing data of the user, which are received from the communication module 210. According to an embodiment of the present disclosure, the memory 230 may store a playing result of the user, which is determined by a playing result determination module 241. According to an embodiment of the present disclosure, the memory 230 may store a pattern analysis algorithm According to an embodiment of the present disclosure, the memory 230 may store a playing pattern of the user, which is determined by the pattern analysis algorithm. According to an embodiment of the present disclosure, the memory 230 may store sheet music data.

The control module 240 may control an overall operation of the second electronic device 200. For example, the control module 240 may drive an operating system (OS) or an application program (e.g., a string instrument lesson application), may control a plurality of hardware or software components connected to the control module 240, and may perform a variety of data processing and calculation.

According to an embodiment of the present disclosure, the control module 240 may include the playing result determination module 241 and a pattern analysis module 243.

According to an embodiment of the present disclosure, the playing result determination module 241 may determine a performing technique of the user using playing data. For example, the playing result determination module 241 may determine that the user uses any bowing technique using playing data associated with motion of the bow. If the bow moves at half or more of the entire length of the bow within a certain time period (e.g., 1500 milliseconds), the playing result determination module 241 may determine that the user uses a staccato playing style. If the user plays two or more tones without changing a direction of the bow, the playing result determination module 241 may determine that the user uses a slur technique or a tie technique.

According to an embodiment of the present disclosure, the playing result determination module 241 may compare playing data with sheet music data and may determine a playing result of the user. For example, the playing result determination module 241 may determine whether the user plays the string instrument to be the same as the sheet music data or whether a playing error occurs. According to an embodiment of the present disclosure, the playing result determination module 241 may determine a playing result of the user according to a pitch (or fingering), a rhythm, and a bowing. For example, the pitch may be determined according to whether a pitch of sheet music data is identical to a pitch of playing data (or whether different between the pitch of the sheet music data and the pitch of the playing data is within a predetermined error range). The rhythm may be determined according to whether timing at which a tone is generated by music data is identical to timing at which a tone is generated by playing data (or whether a difference between the timing at which the tone is generated by sheet music data is identical to the timing at which the tone is generated by the playing data is within a predetermined error range). The bowing may be determined according to whether a motion or a performing technique of the bow for playing data are identical to a motion or a performing technique of the bow for music data (or whether a difference between the motion or the performing technique of the bow for the playing data and the motion or the performing technique of the bow for the music data is within a predetermined error range).

According to an embodiment of the present disclosure, the playing result determination module 241 may provide feedback on a playing result. According to an embodiment of the present disclosure, if a playing error occurs, the playing result determination module 241 may provide error information and error correction information in real time. According to an embodiment of the present disclosure, the playing result determination module 241 may provide feedback in the form of an image or text through the display 250 or may provide feedback in the form of a voice through the audio module 260. According to an embodiment of the present disclosure, if the user completes his or her playing, the playing result determination module 241 may integrate playing results of the user and may provide feedback on the integrated playing result. For one example, the playing result determination module 241 may provide feedback on a playing result for each determination element (e.g., each pitch, each rhythm, and each bowing). For another example, the playing result determination module 241 may provide feedback on an integrated playing result in which a plurality of determination elements are integrated.

According to an embodiment of the present disclosure, the pattern analysis module 243 may analyze a playing pattern of the user using his or her playing data. The playing pattern of the user may include a normal playing pattern generated when the user skillfully plays the string instrument and an error playing pattern generated when the user often makes the mistake of playing the string instrument. For example, the pattern analysis module 243 may determine whether the user often makes the mistake of any finger, whether the user often makes the mistake of fingering on any string, and whether the user often makes the mistake of bowing on any string. According to an embodiment of the present disclosure, the pattern analysis module 243 may analyze a playing pattern of the user using the pattern analysis algorithm stored in the memory 230. According to an embodiment of the present disclosure, the pattern analysis algorithm may learn a playing pattern using a normal playing pattern database and an error pattern database.

According to an embodiment of the present disclosure, the pattern analysis module 243 may provide feedback associated with a playing pattern of the user. According to an embodiment of the present disclosure, the pattern analysis module 243 may provide feedback in the form of an image or text through the display 250 or may provide feedback in the form of a voice through the audio module 260. According to an embodiment of the present disclosure, the pattern analysis module 243 may analyze the playing result of the user, determined by the playing result determination module 241, in real time to analyze an error pattern. The pattern analysis module 243 may provide correction information, about the error pattern analyzed in real time, in real time.

According to an embodiment of the present disclosure, if the playing of the user is completed, the pattern analysis module 243 may analyze his or her entire playing result to analyze a playing pattern. According to an embodiment of the present disclosure, if the playing of the user is completed, the pattern analysis module 243 may provide feedback (e.g., correction information associated with an error pattern or lecture content associated with the error pattern) associated with an analyzed playing pattern. According to an embodiment of the present disclosure, the pattern analysis module 243 may count the number of times a playing pattern is generated and may provide feedback according to the number of times the playing pattern is generated. In other words, the pattern analysis module 243 may provide feedback associated with a playing pattern in consideration of a previously analyzed playing pattern together. Table 1 represents an example of an error pattern which may be analyzed by the pattern analysis module 243 and an example of correction information about the error pattern.

TABLE 1

| error pattern | correction information |
|---|---|
| The tone is generally increased after fingering with your fourth finger. | Your thumb can be followed to the bridge while fingering with your fourth finger.<br>You need the strength of your hand.<br>Follow the stretching while watching the video. |
| The bow is slanted to your body whenever you play your string instrument with its lower part. - The wrist problem | The bow is slanted to your body again and again. Fold your wrist to a lower side and start bowing. |
| The bow is slanted to your body whenever you play your string instrument with its lower part. - In the case where your shoulder is braced (the upper arm) | The bow is slanted to your body again and again. Relax your shoulder while putting your bow down and simultaneously pull your elbow to a half point of your bow in the outer direction while unfolding your arm. |

TABLE 1-continued

| error pattern | correction information |
|---|---|
| The bow is slanted to your body whenever you play your string instrument with its lower part. - The grip problem | The bow is slanted to your body again and again. If you hold your bow incorrectly, since the bow moves along strings in a lower part of the bow, the string instrument does not sound good. Note the grip technique, and start bowing while relaxing your fingers. |
| The bow is slanted to your body whenever you play the string instrument with its lower part. - the motion problem of your arm (the lower limbs) | The bow is slanted to your body again and again. Your elbow is no longer moved to the outside from a point where you put the bow down about half. Move a lower part of your arm and draw the bow. |
| The bow is slanted to your body whenever you play the string instrument with its lower part. - Your wrist/the lower limbs/grip/the upper arm | The bow is slanted to your body again and again. |
| Posture of your body is no upright. | Stretch your back and play the string instrument. In the case where you play the G string, you play it while bending your waist forward. However, if you bend your waist forward, it is difficult to bow the A and E strings. |

According to an embodiment of the present disclosure, if data necessary for a specific operation are not stored in the memory 230, the control module 240 may request the server 400 to send the necessary data through the communication module 210 and may receive the requested data from the server 400 through the communication module 210. For example, the control module 240 may request the server 400 to send old playing data of the user, his or her playing result, his or her playing pattern, content associated with the playing pattern, and the like and may receive the old playing data, the playing result, the playing pattern, the content associated with the playing pattern, and the like from the server 400.

According to an embodiment of the present disclosure, the control module 240 may determine whether it is necessary for tuning the string instrument using playing data. For example, the control module 240 may compare a frequency obtained from a tone necessary for playing an open string with a theoretical frequency of the open string while the user plays the string instrument. If a difference between the frequency obtained from the tone necessary for playing the open string and the theoretical frequency of the open string is greater than or equal to a specific value (e.g., 5 Hz), the control module 160 may determine that it is necessary for tuning the corresponding string. According to an embodiment of the present disclosure, if determining that it is necessary for tuning the string instrument, the control module 240 may inform the user that it is necessary for tuning the string instrument through the display 250 or the audio module 260. According to an embodiment of the present disclosure, if determining that it is necessary for tuning the string instrument, the control module 240 may display a user interface, for selecting whether to enter a tuning mode, on the display 250. According to an embodiment of the present disclosure, if the user selects to enter the tuning mode, the control module 240 may display a user interface, for entering the tuning mode and guiding the user to tune the string instrument, on the display 250.

According to an embodiment of the present disclosure, the display 250 may display a user interface provided from a string instrument lesson application. The user interface may include, for example, a playing result of the user, error information, error correction information, recommended content, and lesson content. According to an embodiment of the present disclosure, the user interface may provide a playing result of the user in real time according to his or her playing data. For example, the user interface may provide a fingering position of the user and motion of the bow in real time. According to an embodiment of the present disclosure, the user interface may provide error information and error correction information according to a playing result of the user in real time. According to an embodiment of the present disclosure, if the playing of the user is completed, the user interface may provide recommended content and lesson content according to a playing pattern and an error pattern of the user.

Figure 18:
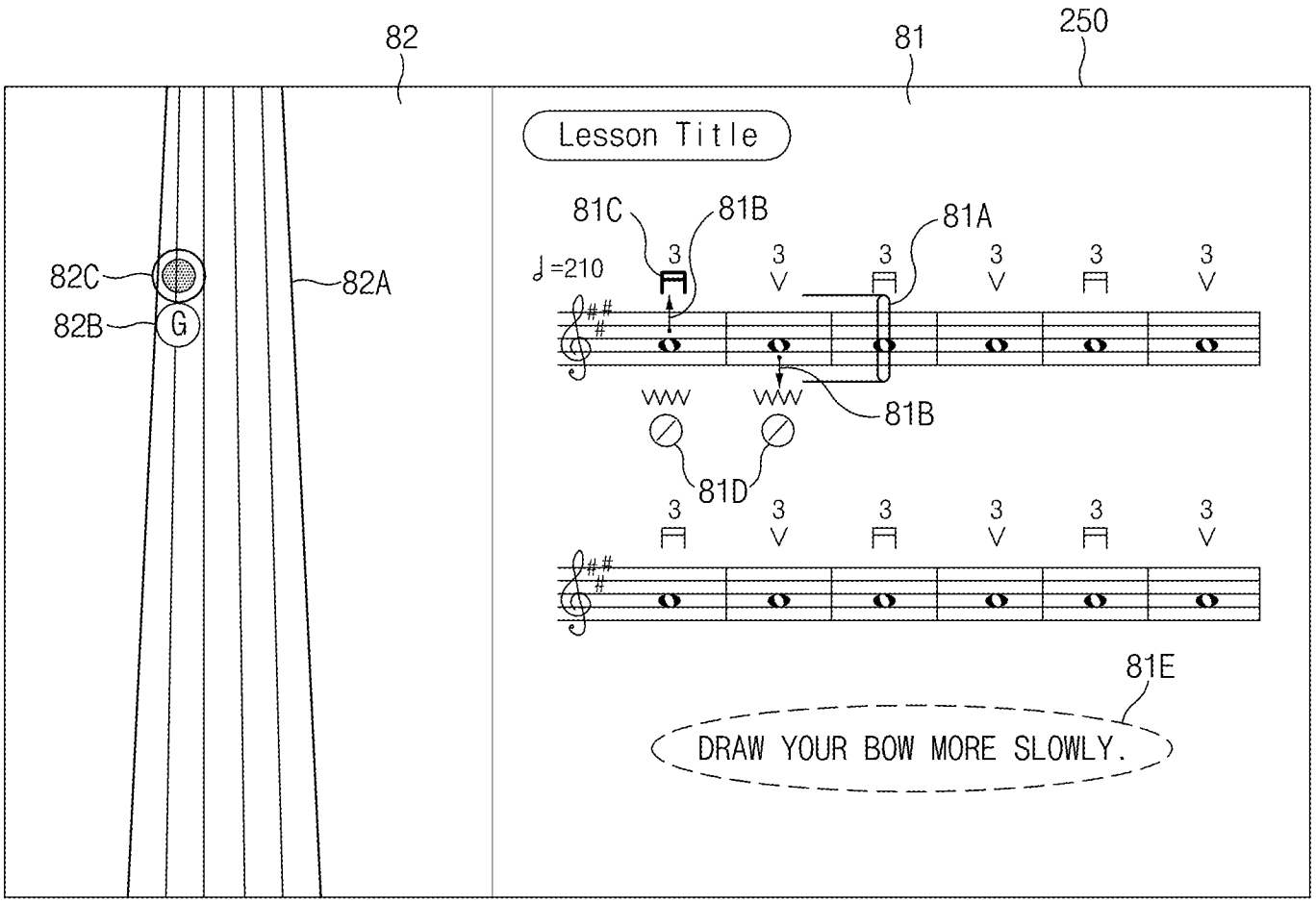
FIG. 18 is a drawing illustrating a user interface according to an embodiment of the present disclosure.

FIG. 18 is a drawing illustrating a user interface according to an embodiment of the present disclosure.

Referring to FIG. 18, a display 250 may display a user interface including a real-time playing result of the user, error information, and error correction information. According to an embodiment of the present disclosure, the user interface may include a region 81 (or a sheet music region 81) for displaying sheet music and a region 82 (or a fingering region 82) for visualizing and displaying a fingering position.

The sheet music region 81 may display sheet music data. According to an embodiment of the present disclosure, the sheet music region 81 may include an indicator 81A indicating a current playing position. The indicator 81A may move over, for example, time. If an error occurs in playing of the user, the sheet music region 81 may display error information and error correction information. For one example, if the user plays the string instrument to have a high pitch or a low pitch, the sheet music region 81 may display a pitch correction object 81B. For another example, if an up/down direction of a bow is incorrect, the sheet music region 81 may display an up/down symbol 81C in a different way. For one example, a size, a color, and brightness of the up/down symbol 81C may be changed or a highlight or blinking effect may be applied to the up/down symbol 81C. For another example, if a position or an angle of the bow is incorrect, the sheet music region 81 may display a bow correction object 81D. For another example, if a speed of the bow is incorrect, the sheet music region 81 may display an object 81E for guiding the user to correct the speed of the bow.

According to an embodiment of the present disclosure, the fingering region 82 may display a fingerboard image 82A of the string instrument. According to an embodiment of the present disclosure, the fingerboard image 82A may display an object 82B indicating a finger position which should be currently played. Also, the fingerboard image 82A may display an object 82C indicating a real fingering position according to playing data of the user. According to an embodiment of the present disclosure, the object 82C indicating the real fingering position may be displayed only if an error occurs.

Figure 19:
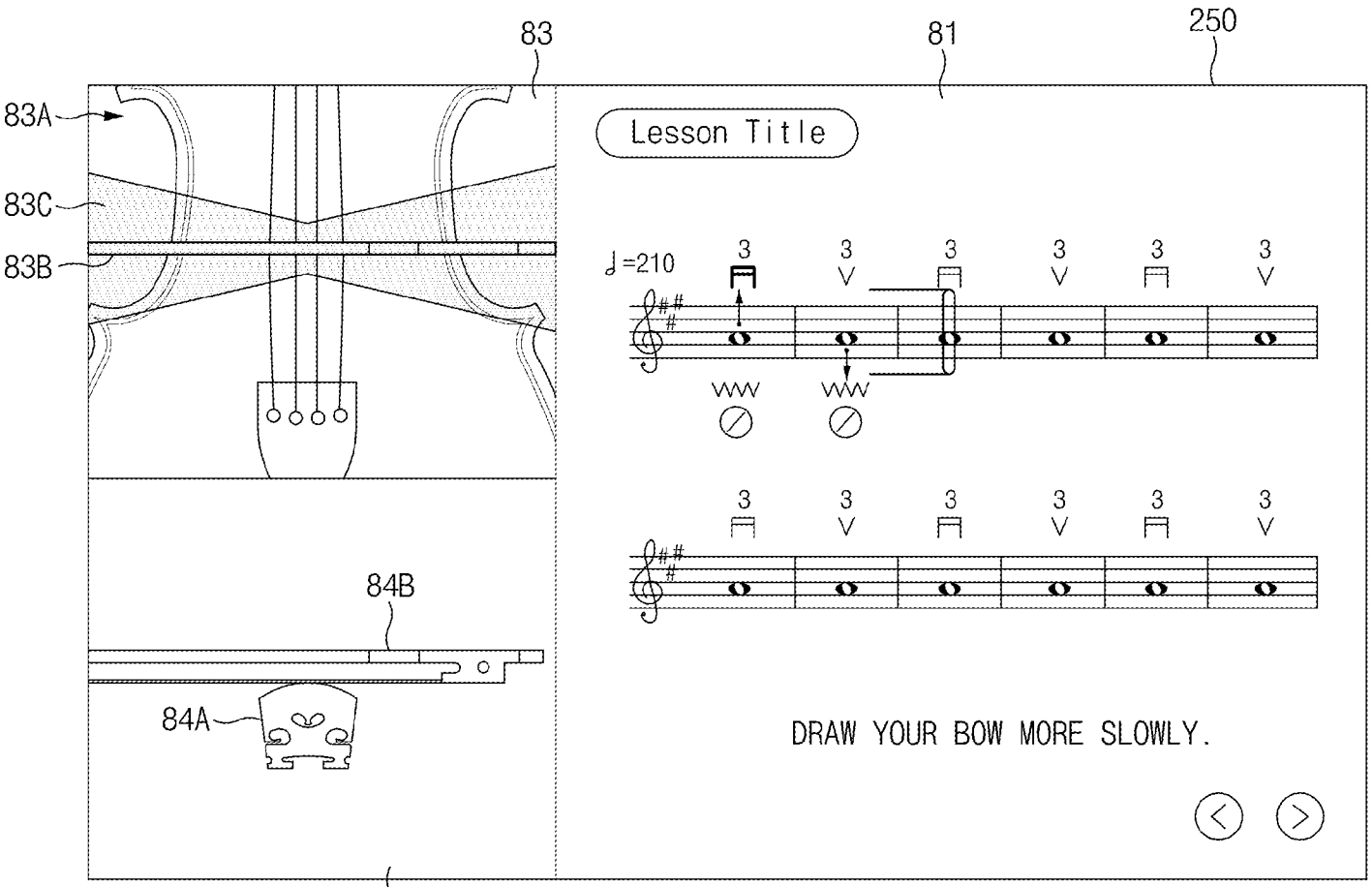
FIG. 19 is a drawing illustrating a user interface according to an embodiment of the present disclosure.

FIG. 19 is a drawing illustrating a user interface according to an embodiment of the present disclosure.

Referring to FIG. 19, a display 250 may display a user interface including a real-time playing result of a user, error information, and error correction information. According to an embodiment of the present disclosure, the user interface may include a region 81 (or a sheet music region 81) for displaying sheet music and regions 83 and 84 (or bowing regions 83 and 84) for visualizing and displaying motion of a bow.

The sheet music region 81 may display sheet music data. Since the sheet music region 81 is described with reference to FIG. 18, a detailed description for this is omitted below.

According to an embodiment of the present disclosure, the bowing regions 83 and 84 may include the region 83 (or the skewness region 83) for displaying a skewness of the bow in the direction of a fingerboard and the region 84 (or the inclination region 84) for displaying an inclination of the bow in the direction of a body of a string instrument. According to an embodiment of the present disclosure, the skewness region 83 may display an image 83A of a c-bout of the string instrument and a bow image 83B. According to an embodiment of the present disclosure, an angle and a position of the bow image 83B may be changed according to real bowing of the user. For example, the angle and the position of the bow image 83B may be determined by a skewness of the bow in the direction of the fingerboard and a longitudinal position of the bow, which are included in playing data of the user. According to an embodiment of the present disclosure, the skewness region 83 may display a range 83C in which the bow may move. According to an embodiment of the present disclosure, if the bow image 83B departs from the range 83C in which the bow may move, a color and brightness of the range 83C in which the bow may move may be changed, or a highlight or blinking effect may be applied to the range 83C. According to an embodiment of the present disclosure, the inclination region 84 may display a bridge image 84A and a bow image 84B of the string instrument. According to an embodiment of the present disclosure, an angel and a position of the bow image 84B may be changed according to real bowing of the user. For example, the position and the angle of the bow image 83B may be determined by an inclination of the bow in the direction of the body of the string instrument and a lateral position of the bow, which are included in playing data of the user.

Figure 20:
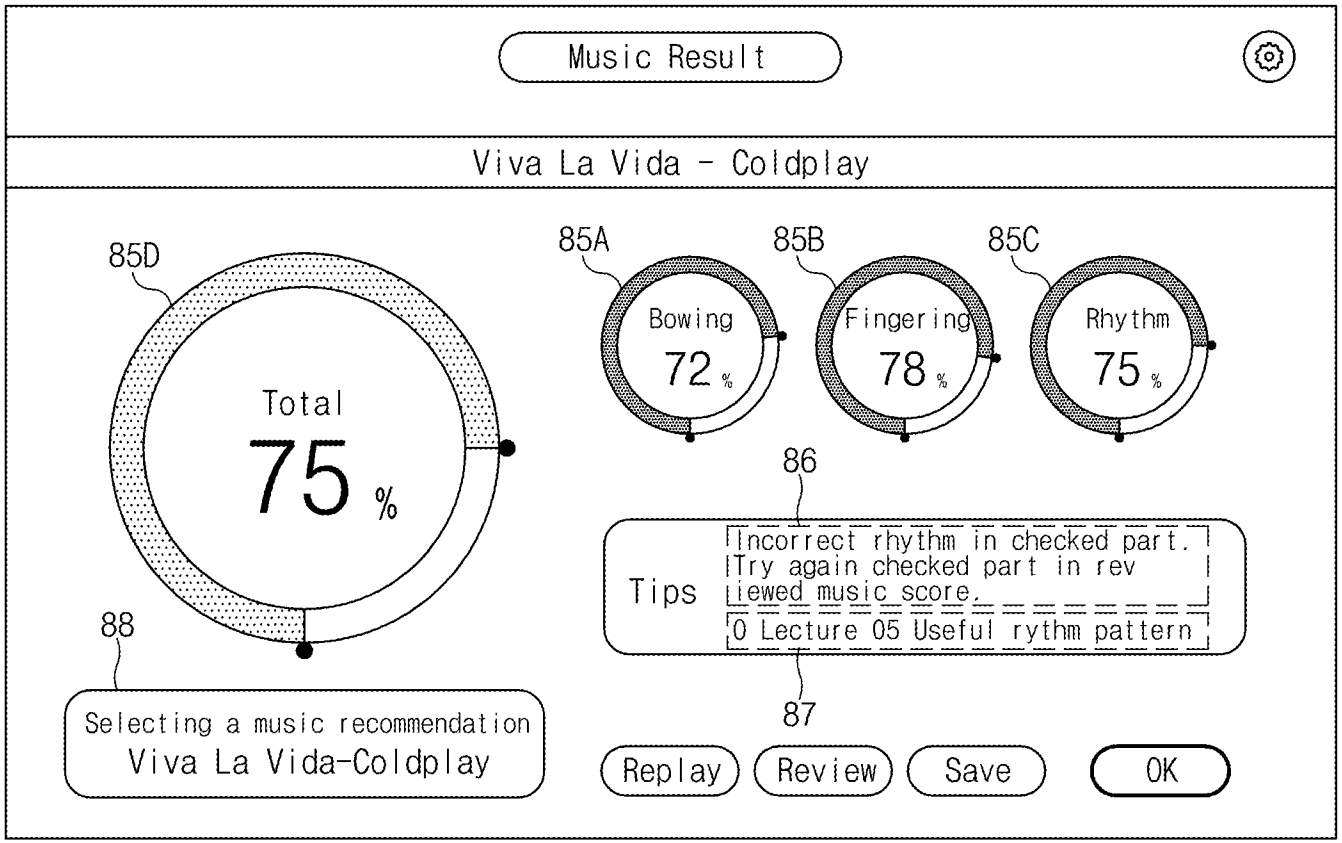
FIG. 20 is a drawing illustrating a user interface according to an embodiment of the present disclosure.

FIG. 20 is a drawing illustrating a user interface according to an embodiment of the present disclosure.

Referring to FIG. 20, if playing of a user is ended, a display 250 of FIG. 17 may display a user interface which includes a playing result of the user, error information, error correction information, and content associated with his or her playing pattern. According to an embodiment of the present disclosure, the user interface may include an icon indicating a playing result for each determination element (e.g., each bowing 85A, each pitch 85B (or each fingering 85B), and each rhythm 85C). According to an embodiment of the present disclosure, the user interface may include an icon 85D indicating an overall playing result. According to an embodiment of the present disclosure, the user interface may include error correction information 86 about a playing result of the user. For example, the error correction information 86 may be provided in the form of text. According to an embodiment of the present disclosure, the user interface may include content 87 associated with an error pattern of the user. For example, a study or lecture content for correcting an error pattern of the user may be provided in the form of a link. According to an embodiment of the present disclosure, the user interface may include content 88 associated with a normal playing pattern of the user. For example, recommended music, including a normal playing pattern of the user, the user may plays without any difficulty may be provided in the form of a link. According to an embodiment of the present disclosure, if the user inputs a user instruction for selecting the content 87 associated with the error pattern, the display 250 may display a user interface shown in FIG. 21.

Figure 21:
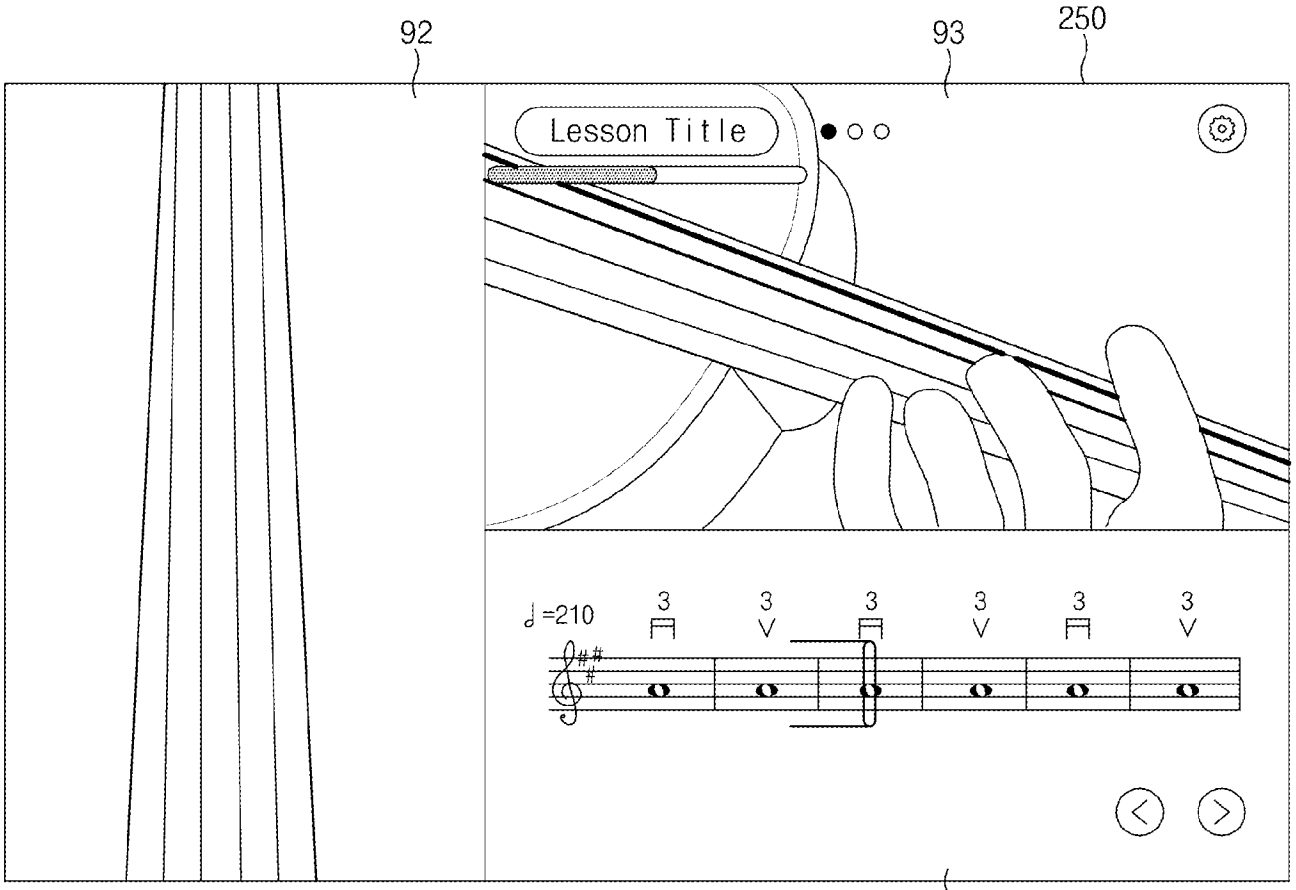
FIG. 21 is a drawing illustrating a user interface according to an embodiment of the present disclosure.

FIG. 21 is a drawing illustrating a user interface according to an embodiment of the present disclosure.

Referring to FIG. 21, a display 250 may display a user interface associated with a lecture content. The user interface may include a region 91 (or a sheet music region 91) for displaying sheet music, a region 92 (or a fingering region 92) for visualizing and displaying a fingering position, and a region 93 on which a video lecture is played. According to an embodiment of the present disclosure, details displayed on the music region 91 and the fingering region 92 may be changed in response to details of lecture content. For one example, sheet music displayed on the music region 91 may be changed according to details of lecture content. For another example, the fingering region 92 may be changed to a region for displaying an angle of a bow, according to details of lecture content.

An audio module (e.g., 260 of FIG. 17) may generate and output an audio signal. For example, the audio module 260 may include an audio interface which may connect with a speaker or an earphone (or a headphone) or an embedded speaker. According to an embodiment of the present disclosure, the audio module 260 may generate an audio signal using playing data.

FIGS. 22A to 22D are drawings illustrating a user interface according to various embodiments of the present disclosure.

FIGS. 22A to 22D illustrate a user interface which provides real-time correction information if a second electronic device 200 is implemented with a smart watch. For example, if a user plays the string instrument using paper sheet music, the second electronic device 200 may analyze a playing result and a playing pattern of the user in real time and may provide correction information.

Figure 22A:
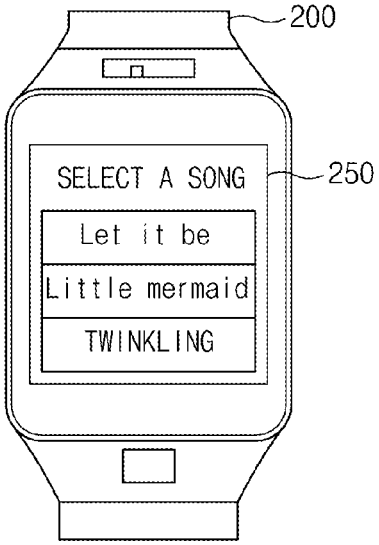
FIGS. 22A to 22D are drawings illustrating a user interface according to various embodiments of the present disclosure.
Figure 22B:
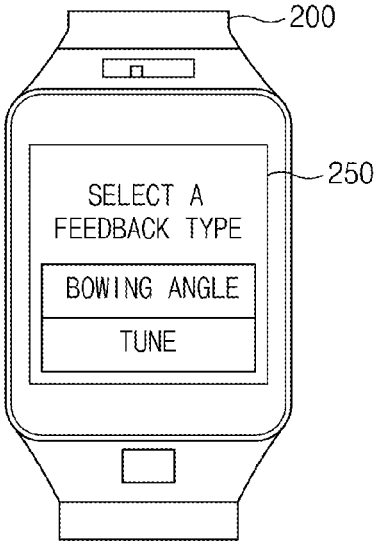
Figure 22C:
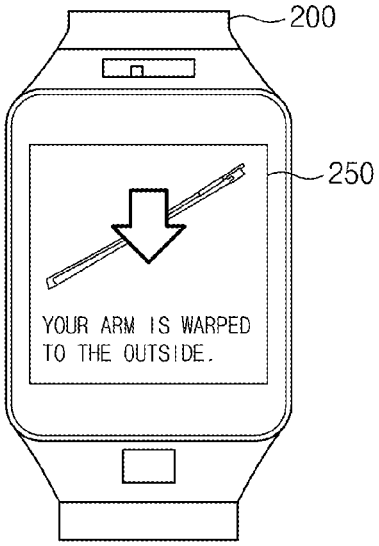
Figure 22D:
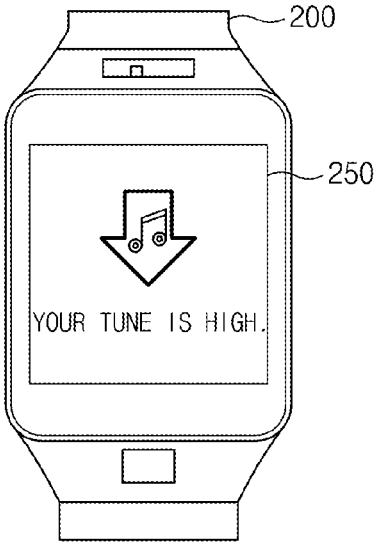

Referring to FIG. 22A, a display 250 may provide a user interface which allows the user to select music (or sheet music) to be played. For example, the display 250 may display a list of sheet music data stored in a memory 230 of FIG. 17. Referring to FIG. 22B, the display 250 may display a user interface which allows the user to select a type of correction information. For example, the type of the correction information may include at least one of a bowing, a tone (or fingering), and a rhythm, which are elements for determining a playing result of the user. According to an embodiment of the present disclosure, if the user selects one of determination elements, the display 250 may display a user interface which allows the user to select full details of the selected determination element. Referring to FIGS. 22C and 22D, the display 250 may display correction information according to a playing result of the user and a result of analyzing a playing pattern in real time.

For example, if the user plays the string instrument, a first electronic device 100 of FIG. 1 may determine a pitch (or a frequency) of a tone generated by the playing of the string instrument. The first electronic device 100 may send the determined pitch (or the determined frequency) to the second electronic device 200. The second electronic device 200 may perform an operation corresponding to the pitch.

Figure 23:
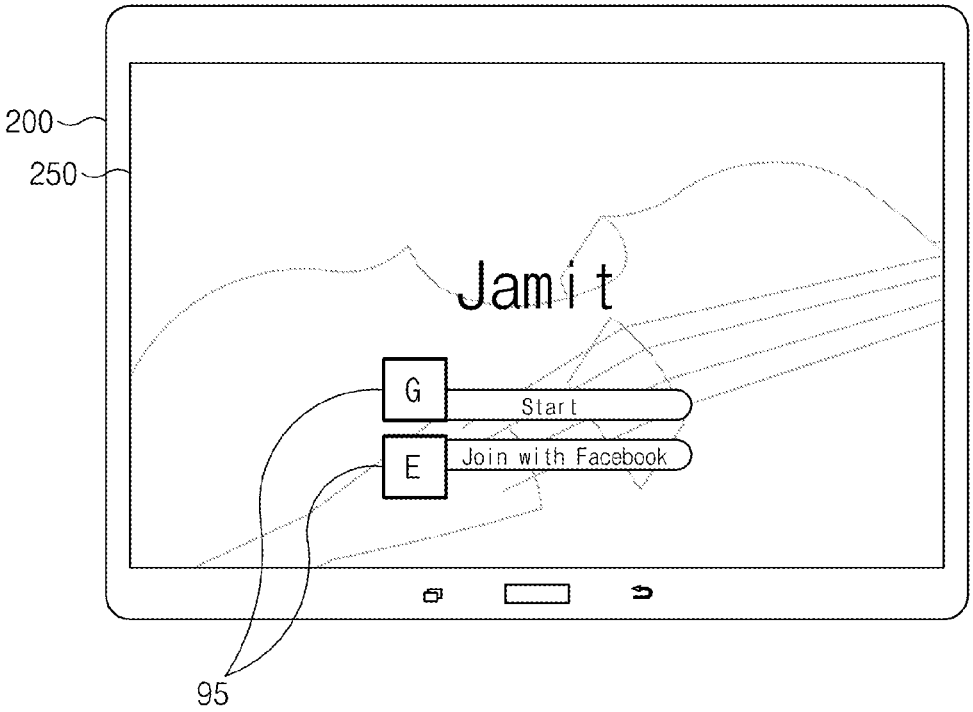
FIG. 23 is a drawing illustrating a user interface according to an embodiment of the present disclosure.

FIG. 23 is a drawing illustrating a user interface according to an embodiment of the present disclosure.

According to an embodiment of the present disclosure, a user may input a user instruction to a second electronic device 200 by playing the string instrument. Referring to FIG. 23, the second electronic device 200 may display a user interface corresponding to a start screen of a string instrument lesson application. According to an embodiment of the present disclosure, the user interface may include a plurality of menus and code information 95 corresponding to each of the plurality of menus. If the user plays a tone corresponding to a specific code, a first electronic device (e.g., 100 of FIG. 1) may determine a pitch (or a frequency) of a tone generated by playing of the string instrument. The first electronic device 100 may send the determined pitch (or the determined frequency) to the second electronic device 200. The second electronic device 200 may perform an operation corresponding to the pitch. For example, in FIG. 23, if the user plays a G code, the string instrument lesson application is started.

According to an embodiment of the present disclosure, the user may input a user instruction to the second electronic device 200 through a motion of the string instrument. For example, if the user moves the string instrument, the first electronic device 100 attached to the string instrument may sense motion of the string instrument using an inertial measurement unit. The first electronic device 100 may send motion information of the string instrument to the second electronic device 200. The second electronic device 200 may perform an operation corresponding to the motion of the string instrument.

Figure 24:
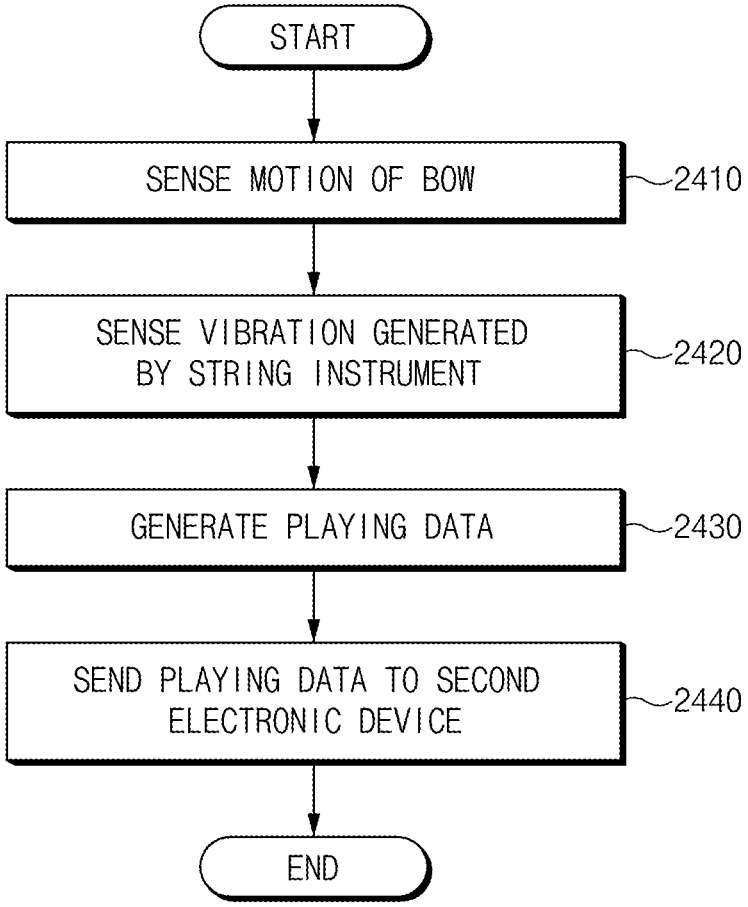
FIG. 24 is a flowchart illustrating a method for recognizing the playing of a string instrument in a first electronic device according to an embodiment of the present disclosure.

FIG. 24 is a flowchart illustrating a method for recognizing the playing of a string instrument in a first electronic device according to an embodiment of the present disclosure. Operations shown in FIG. 24 may include operations processed by a first electronic device (e.g., 100 shown in FIG. 4). Therefore, although there are contents omitted below, contents described about the first electronic device 100 with reference to FIGS. 4 to 16 may be applied to the operations shown in FIG. 24.

Referring to FIG. 24, in operation 2410, the first electronic device 100 may detect motion of a bow. According to an embodiment of the present disclosure, the first electronic device 100 may sense a motion of the bow using an image sensor. According to an embodiment of the present disclosure, the first electronic device 100 may sense a motion of the bow using a metal sensor or a magnetic field sensor.

According to an embodiment of the present disclosure, in operation 2420, the first electronic device 100 may detect a vibration generated by a string instrument. According to an embodiment of the present disclosure, the first electronic device 100 may sense a vibration generated by the string instrument using a vibration sensor.

According to an embodiment of the present disclosure, in operation 2430, the first electronic device 100 may analyze the motion of the bow and the vibration of the string instrument and may generate playing data. The playing data may include, for example, at least one of a pitch, a sound intensity, a rhythm, a longitudinal position of the bow, a lateral position of the bow, a relative tilt between the bow and a string, a skewness of the bow in the direction of a fingerboard, an inclination of the bow in the direction of a body of the string instrument, a type of a string with which the bow makes contact, a fingering position of a user, or a velocity of the bow.

According to an embodiment of the present disclosure, the first electronic device 100 may determine a longitudinal position of the bow, a skewness of the bow in the direction of the fingerboard, an inclination of the bow in the direction of the body of the string instrument, and a velocity of the bow using a sensing value of the image sensor. According to an embodiment of the present disclosure, the first electronic device 100 may binarize an infrared image of the image sensor and may determine the above-mentioned elements, that is, a longitudinal position of the bow, a skewness of the bow in the direction of the fingerboard, an inclination of the bow in the direction of the body of the string instrument, and a velocity of the bow using the binarized image. According to an embodiment of the present disclosure, the first electronic device 100 may determine a velocity (e.g., a direction and a speed) of the bow using a sensing value of the metal sensor. According to an embodiment of the present disclosure, the first electronic device 100 may determine a lateral position of the bow and velocity (e.g., a direction and a speed) of the bow using a sensing value of the magnetic field sensor. According to an embodiment of the present disclosure, the first electronic device 100 may determine a string, with which the bow makes contact, using an inclination of the bow in the direction of the body of the string instrument.

According to an embodiment of the present disclosure, the first electronic device 100 may analyze a vibration sensed by the vibration sensor and may determine a pitch, a sound intensity, and a rhythm According to an embodiment of the present disclosure, the first electronic device 100 may determine a pitch using a frequency component, which may be generated by a string with which the bow makes contact, among a plurality of frequency components included in vibration. According to an embodiment of the present disclosure, the first electronic device 100 may apply a window function when transforming a vibration sensed by the vibration sensor from a time domain to a frequency domain to sense a pitch. According to an embodiment of the present disclosure, the first electronic device 100 may set a size of a time axis of the window function in a different way according to a type of a string with which the bow makes contact.

According to an embodiment of the present disclosure, the first electronic device 100 may determine a fingering position of the user according to a pitch and a string with which the bow makes contact. According to an embodiment of the present disclosure, the first electronic device 100 may determine a fingering position of a string with which the bow makes contact among a plurality of fingering positions corresponding to a pitch as a fingering position of the user.

According to an embodiment of the present disclosure, in operation 2440, the first electronic device 100 may send the playing data to a second electronic device 200 of FIG. 1.

Figure 25:
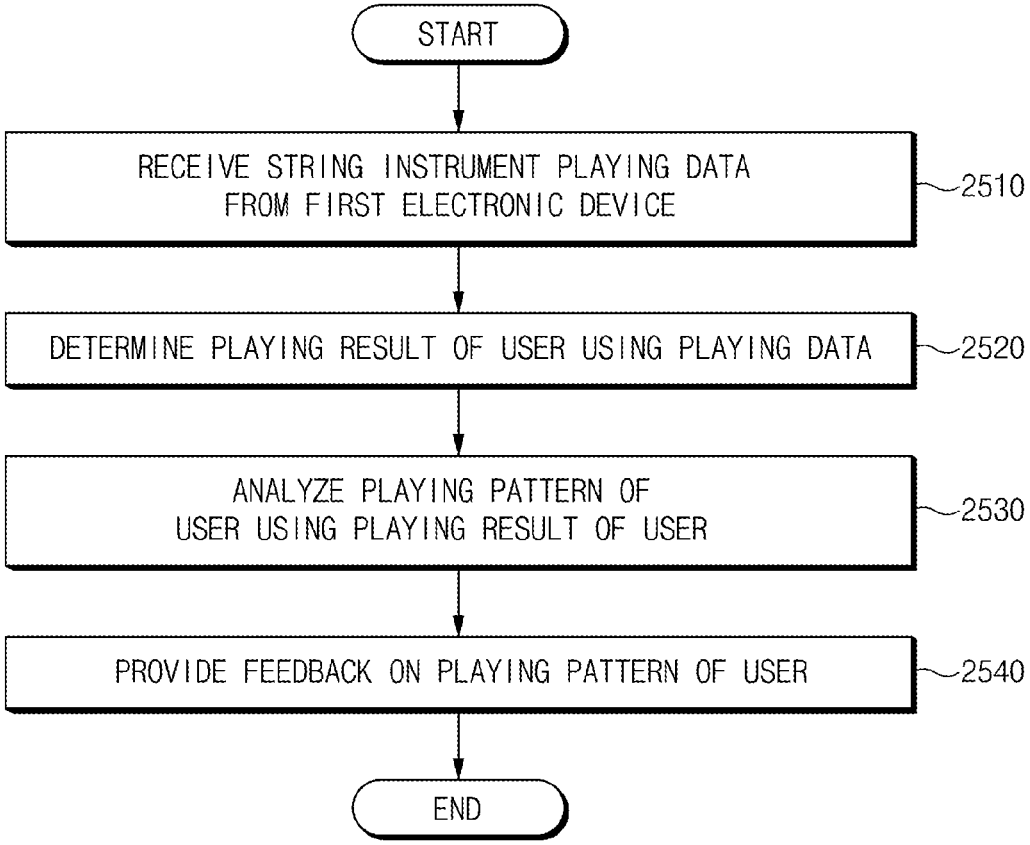
FIG. 25 is a flowchart illustrating a method for providing feedback on the playing of a string instrument in a second electronic device according to an embodiment of the present disclosure.

FIG. 25 is a flowchart illustrating a method for providing feedback on the playing of a string instrument in a second electronic device according to an embodiment of the present disclosure. Operations shown in FIG. 25 may include operations processed by a second electronic device (e.g., 200 shown in FIG. 17). Therefore, although there are contents omitted below, contents described about the second electronic device 200 with reference to FIGS. 17 to 23 may be applied to the operations shown in FIG. 25.

Referring to FIG. 25, in operation 2510, the second electronic device 200 may receive string instrument playing data from a first electronic device (e.g., 100 of FIG. 1). The playing data may include, for example, at least one of a pitch, a sound intensity, a rhythm, a longitudinal position of the bow, a lateral position of the bow, a relative tilt between the bow and a string, a skewness of the bow in the direction of a fingerboard, an inclination of the bow in the direction of a body of the string instrument, a type of a string with which the bow makes contact, a fingering position of a user, or a velocity of the bow.

According to an embodiment of the present disclosure, in operation 2520, the second electronic device 200 may determine a playing result of the user using the playing data. According to an embodiment of the present disclosure, the second electronic device 200 may determine whether the user uses any performing technique using the playing data. According to an embodiment of the present disclosure, the second electronic device 200 may compare the playing data with sheet music data and may determine a playing result of the user in real time. For example, the second electronic device 200 may determine whether the user plays the string instrument to be the same as sheet music data or whether a playing error occurs. According to an embodiment of the present disclosure, the second electronic device 200 may determine a playing result of the user according to a pitch (or fingering), a rhythm, and a bowing.

According to an embodiment of the present disclosure, if the playing error occurs, the second electronic device 200 may provide error information and error correction information in real time. According to an embodiment of the present disclosure, the second electronic device 200 may provide feedback in the form of an image or text through its display or may provide feedback in the form of a voice through its audio module. According to an embodiment of the present disclosure, if playing of the user is completed, the second electronic device 200 may integrate playing results of the user and may provide feedback on the integrated playing result.

According to an embodiment of the present disclosure, in operation 2530, the second electronic device 200 may analyze a playing pattern of the user using his or her playing result. The playing pattern of the user may include, for example, a normal playing pattern generated when the user skillfully plays the string instrument and an error playing pattern generated when the user often makes the mistake of playing the string instrument. According to an embodiment of the present disclosure, the second electronic device 200 may analyze a playing pattern of the user using the pattern analysis algorithm stored in its memory. According to an embodiment of the present disclosure, the pattern analysis algorithm may learn a playing pattern using a normal playing pattern database and an error pattern database.

According to an embodiment of the present disclosure, the second electronic device 200 may analyze a playing result of the user in real time to analyze an error pattern. According to an embodiment of the present disclosure, if the playing of the user is completed, the second electronic device 200 may analyze the entire playing result of the user to analyze a playing pattern.

According to an embodiment of the present disclosure, in operation 2540, the second electronic device 200 may provide feedback on the playing pattern of the user. According to an embodiment of the present disclosure, the second electronic device 200 may provide feedback in the form of an image or text through the display or may provide feedback in the form of a voice through the audio module. According to an embodiment of the present disclosure, the second electronic device 200 may provide correction information, about an error pattern analyzed in real time, in real time. According to an embodiment of the present disclosure, if the playing of the user is completed, the second electronic device 200 may provide feedback (e.g., correction information associated with an error pattern or lecture content associated with the error pattern) associated with an analyzed playing pattern. According to an embodiment of the present disclosure, the second electronic device 200 may count the number of times a playing pattern is generated and may provide feedback according to the number of times the playing pattern is generated.

The terminology "module" used herein may mean, for example, a unit including one of hardware, software, and firmware or two or more combinations thereof. The terminology "module" may be interchangeably used with, for example, terminologies "unit", "logic", "logical block", "component", or "circuit", and the like. The "module" may be a minimum unit of an integrated component or a part thereof. The "module" may be a minimum unit performing one or more functions or a part thereof. The "module" may be mechanically or electronically implemented. For example, the "module" may include at least one of an application-specific integrated circuit (ASIC) chip, field-programmable gate arrays (FPGAs), or a programmable-logic device, which is well known or will be developed in the future, for performing certain operations.

According to various embodiments of the present disclosure, at least part of a device (e.g., modules or the functions) or a method (e.g., operations) may be implemented with, for example, instructions stored in computer-readable storage media which have a program module. When the instructions are executed by a processor (e.g., a control module 160 of FIG. 4 and a control module 240 of FIG. 17), one or more processors may perform functions corresponding to the instructions. The computer-readable storage media may be, for example, a memory 230 of FIG. 17.

The computer-readable storage media may include a hard disc, a floppy disk, magnetic media (e.g., a magnetic tape), optical media (e.g., a compact disc read only memory (CD-ROM) and a DVD), magneto-optical media (e.g., a floptical disk), a hardware device (e.g., a ROM, a random access memory (RAM), or a flash memory, and the like), and the like. Also, the program instructions may include not only mechanical codes compiled by a compiler but also high-level language codes which may be executed by a computer using an interpreter and the like. The above-mentioned hardware device may be configured to operate as one or more software modules to perform operations according to various embodiments of the present disclosure, and vice versa.

According to various embodiments of the present disclosure, the electronic device may obtain accurate string instrument playing data while minimizing a change of a weight of the bow by obtaining string instrument playing data using the device attached to the string instrument and may provide a variety of feedback to the user by processing the obtained playing data as a meaningful form.

Modules or program modules according to various embodiments of the present disclosure may include at least one or more of the above-mentioned components, some of the above-mentioned components may be omitted, or other additional components may be further included therein.

Operations executed by modules, program modules, or other elements may be executed by a successive method, a parallel method, a repeated method, or a heuristic method. Also, some of the operations may be executed in a different order or may be omitted, and other operations may be added. And, embodiments of the present disclosure described and shown in the drawings are provided as examples to describe technical content and help understanding but do not limit the scope of the present disclosure.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic apparatus mountable on a body of a string instrument on which strings are arranged, comprising:

a communicator configured to communicate with a user terminal device;

a vibration sensor configured to sense vibration of the body of the string instrument associated with a performance;

an image sensor configured to sense movement of a bow; and a processor configured to: control the communicator to transmit information on the vibration of the body of the string instrument sensed by the vibration sensor and information on the movement of the bow sensed by the image sensor to the user terminal device, and control the communicator to transmit information on a fingering position to the user terminal device based on the movement of the bow sensed through the image sensor and the vibration of the body of the string instrument sensed by the vibration sensor.

2. The electronic apparatus of claim 1, wherein the electronic apparatus includes a groove for mounting the apparatus to the string instrument.

3. The electronic apparatus of claim 2, wherein the groove has a shape corresponding to a bridge of the string instrument.

4. The electronic apparatus of claim 1, further comprising:

an inertia sensor configured to sense movement of the electronic apparatus corresponding to movement of the string instrument.

5. The electronic apparatus of claim 1, wherein the vibration sensor is disposed on a bottom surface of the electronic apparatus in contact with the string instrument, and wherein the image sensor is disposed to face a top surface of the electronic apparatus.

6. The electronic apparatus of claim 1, wherein the processor is further configured to acquire information on the movement of the bow based on infrared rays that are irradiated from an apparatus attached to the bow and sensed through the image sensor.

7. The electronic apparatus of claim 1, wherein the electronic apparatus is mounted between a bridge of the string instrument and a fingerboard of the string instrument.

8. The electronic apparatus of claim 7, wherein the image sensor is configured to capture images of the strings.

9. The electronic apparatus of claim 8, wherein the processor is further configured to:

when the bow moves across the strings, detect a pattern of the bow, and determine a position of the bow based on the pattern.

10. The electronic apparatus of claim 9, wherein the processor is further configured to determine a skewed angle of the bow.

* * * * *